US006344006B1

(12) United States Patent
Brandt

(10) Patent No.: US 6,344,006 B1
(45) Date of Patent: Feb. 5, 2002

(54) SPORTS RACKET HAVING A UNIFORM STRING STRUCTURE

(76) Inventor: Richard A. Brandt, 69 Fifth Ave., Apt. 16A, New York, NY (US) 10003

( * ) Notice: Subject to any disclaimer, the term of this patent is extended or adjusted under 35 U.S.C. 154(b) by 0 days.

(21) Appl. No.: 09/715,762

(22) Filed: Nov. 17, 2000

(51) Int. Cl.[7] ..... A63B 49/02
(52) U.S. Cl. ..... 473/543
(58) Field of Search ..... 473/524, 532, 473/537, 540, 543, 539, 533, 534; D21/729

(56) References Cited

U.S. PATENT DOCUMENTS

| | | | | | |
|---|---|---|---|---|---|
| 1,536,255 | A | * | 5/1925 | Beal | 473/530 |
| 3,507,494 | A | * | 4/1970 | Finkel | 473/540 X |
| 3,734,499 | A | * | 5/1973 | Goldstein | 473/528 |
| 4,013,289 | A | * | 3/1977 | Kaminstein | 473/537 |
| 4,512,575 | A | * | 4/1985 | Tzeng | 473/537 |
| 4,566,695 | A | * | 1/1986 | Melby | 473/534 |
| 4,750,742 | A | * | 6/1988 | Coupar | 473/540 |
| 4,834,383 | A | | 5/1989 | Woehrle et al. | |
| 4,861,029 | A | * | 8/1989 | Takatsuka | 473/540 |
| 4,964,635 | A | * | 10/1990 | Fitzgerald | 473/521 |
| D339,394 | S | * | 9/1993 | Richards | D21/729 |
| 5,386,991 | A | * | 2/1995 | Rochette | 473/540 |

FOREIGN PATENT DOCUMENTS

| | | | | |
|---|---|---|---|---|
| DE | 3347426 | * | 1/1985 | A63B/51/12 |
| EP | 260208 | * | 3/1988 | 473/FOR 171 |
| FR | 2455906 | * | 1/1981 | 473/FOR 178 |
| GB | 2117253 | * | 10/1983 | 473/FOR 178 |
| NL | 8502294 | * | 3/1987 | 473/FOR 179 |

* cited by examiner

*Primary Examiner*—Raleigh W. Chiu
(74) *Attorney, Agent, or Firm*—Maxim H. Waldbaum

(57) ABSTRACT

A sports racket, for tennis and the like sports, has an elongated handle attached to a head having a racket face, which is spanned by a uniform string structure. The head has four sides, forming a non-elliptical shape, in which the opposite sides are substantially parallel. Longitudinal strings, all of which are substantially identical in length and run essentially parallel to each other, and transversal strings, all of which are substantially identical in length and run essentially parallel to each other and perpendicular to the longitudinal axis, span the racket face. The racket has a larger racket face than conventional rackets, while maintaining the length and weight measurements of conventional rackets, resulting in a very large sweet spot and more good hits. The racket has maximally long strings at all points on the racket face and strings substantially identical in length at all points on the racket face resulting in a uniformity of response for off-center hits, an increase in the ball rebound speed, a decrease in angular deflection for off-center hits, and the ability to set the tension of the strings such that they vibrate with the same frequency. The racket has a greater moment of inertia than conventional rackets, resulting in reduced racket rotation and a reduction of injuries to players, such as "tennis elbow".

3 Claims, 16 Drawing Sheets

SPORTS RACKET HAVING A UNIFORM STRING STRUCTURE

FIELD OF THE INVENTION

The present invention relates to a sports racket. In the preferred embodiment, the present invention relates to a tennis racket having a uniform string structure such that all horizontal (transversal) strings are of equal length and all vertical (longitudinal) strings are of equal length.

BACKGROUND OF THE INVENTION

A range of tennis rackets exist which have been designed to provide a more uniform, powerful, forgiving and controlled response to all hits, and a larger optimal ("sweet spot") area of the racket face.

Typically, when a tennis player swings his racket to hit the ball, he assumes that the impact will be in the sweet spot of the racket face, and he swings accordingly. If the impact location on a conventional racket is not on the sweet spot, or off-center, the ball encounters strings of different length and the resultant ball trajectory is probably not going to be the desired one. Errors such as hits into the net, beyond the baseline, or too near the opponent, will often result. Further, balls hit off-center encounter strings of lengths that are different from one another and different from the lengths of the central strings. The ball will rebound with less speed than, and not consistent with, balls hit near the center of the racket face. Thus, for a given racket swing, the hit ball velocity is highly dependent on where on the face of the racket the ball is hit.

Additionally, with a conventional racket, when a ball strikes parallel strings of equal tension but of different lengths, the strings vibrate with different frequencies, so that the combined effect produces a less-than-optimal ball rebound speed.

In an effort to address some of the above deficiencies in conventional rackets, Woehrle et al., U.S. Pat. No. 4,834,383, disclosed a tennis racket having equal string lengths for a limited section of the racket. In order to achieve equal transversal string lengths over a limited section of the racket, the side central regions of the head of this racket are formed differently than conventional rackets. The side central regions have internal ridges forming flat inner faces and extending parallel to the axis. Longitudinal strings of equal length in this limited section are achieved by providing a reverse or crowned throat on the frame having a curvature identical to the opposite end or crown of the head. The racket was designed with equal string lengths in a limited section of the face of the racket so that, at least in this limited section, the strings would provide substantially the same response.

Further, although the Woehrle et al. patent suggested making the racket strings of equal length in the area of the sweet spot at least, a greater section of the racket face, such consideration was not reduced to practice, but was rejected as unmarketable and unusable. The Woehrle et al. patent stated that "no practical way of achieving this end has been found." Head, U.S. Pat. No. 3,999,756, suggested certain performance advantages provided by rackets with larger (elliptical) faces compared to the conventional rackets then in use. In particular, Head realized that the larger racket would move the racket face area in the beneficial direction toward the racket center of mass, would move the center of the racket face near the racket center of percussion, and would use longer strings which reduce the angular errors resulting from off-center hits.

Since Head's innovation, there have been numerous patents describing further improvements, including the Woehrle et al. patent. Although these developments led to further enhanced performance, the lack of serious computer modeling, as well as the lack of interesting new ideas, have impeded significant progress.

SUMMARY OF THE INVENTION

It is an object of the present invention to provide an improved racket.

It is a further object of the present invention to provide a novel design for a racket, which has a sweet spot that is considerably larger than that of conventional rackets, so that the racket responds with the maximum possible degree of uniformity when a ball is struck almost anywhere on the racket face.

It is a further object of the present invention to provide a novel design for a racket, having a larger face area than conventional rackets, in order to produce more hits and better hits.

It is a further object of the present invention to provide a novel design for a racket, having longer strings over the entire racket face, in order to reduce deflection error for off-center hits.

It is a further object of the present invention to provide a novel design for a racket, having the frame material placed at maximal distance from the central (long) racket axes, in order to increase the moment of inertia ("MOI") of the racket about this axis and minimize the resultant racket rotation away from the ball for off-center hits and thereby increase forgiveness for off-center hits and reduce "tennis elbow" and related injuries.

It is a further object of the present invention to provide a novel design for a racket which provides greater ball control.

It is a further object of the present invention to provide a novel design for a racket in which the tensions and/or mass densities for the transversal and longitudinal strings may be chosen so that all of the strings on the racket vibrate with the same frequency in order to optimize both consistency and performance.

Accordingly, the present invention is a racket having a non-elliptical shaped head and racket face and an elongated handle. The overall width and length of the racket face are comparable to those of conventional (generally oval shaped) racket faces, but the racket face area is much larger. The racket face area is the largest possible for a given racket face width and length, providing a much larger sweet spot than a conventional racket. The new invention further provides maximally long strings at all points on the racket face.

The racket has a uniform string structure in which all of the transversal strings are equal in length and all of the longitudinal strings are equal in length. The means of attaching the strings to the frame of the present invention is the same as in conventional rackets.

DETAILED DESCRIPTION OF THE INVENTION

The sports racket having a uniform string structure of the present invention will be described in the context of a preferred embodiment, namely a tennis racket. The novel aspects of the tennis racket described herein are applicable to other sports such as racquetball and squash. Accordingly, all such sports rackets incorporating the novel elements of the present invention are considered as within the scope of the present invention.

Figure 1:
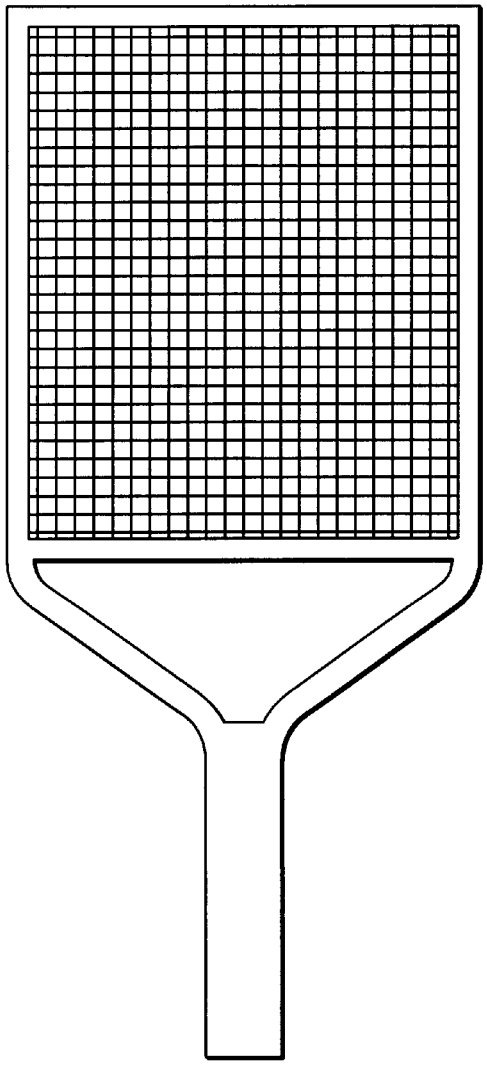
FIG. 1 illustrates the front view of one embodiment of the racket according to this invention, having a rectangular shaped head and racket face, with opposite sides parallel.

As seen in FIG. 1, the sports racket includes a handle 5 and a head 10 having a racket face 15 with transversal strings 25 and longitudinal strings 20.

Figure 2:
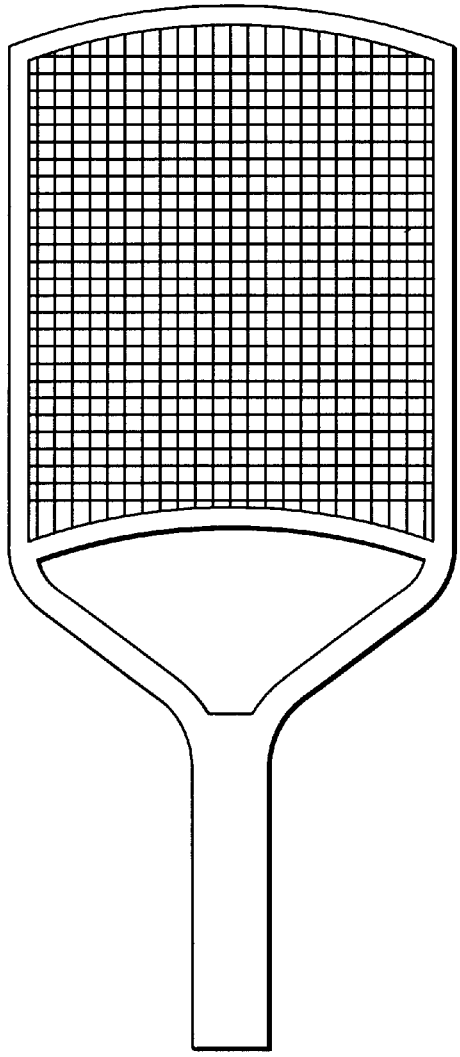
FIG. 2 illustrates the front view of another embodiment of the racket according to this invention in which the transversal sides of the racket face curve upward and are parallel throughout their length.
Figure 3:
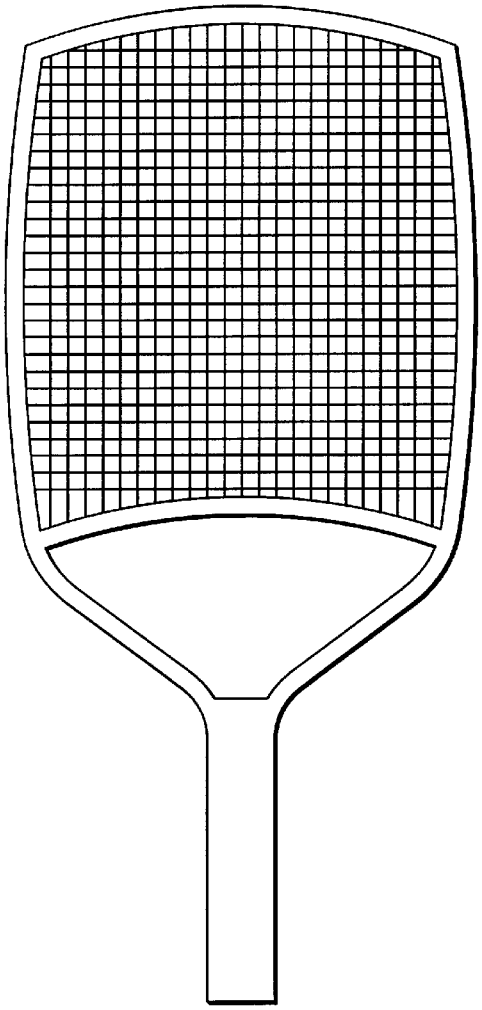
FIG. 3 illustrates the front view of another embodiment of the racket according to this invention in which the transversal sides of the racket face curve upward and are parallel throughout their length and the longitudinal sides, having a slight curvature outward.
Figure 4:
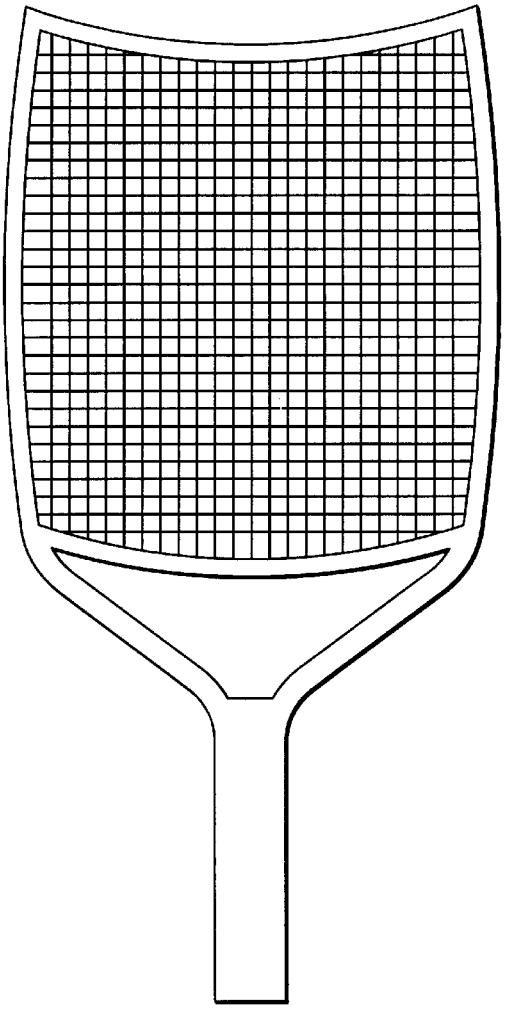
FIG. 4 illustrates the front view of another embodiment of the racket according to this invention in which the transversal sides of the racket face curve downward and are parallel throughout their length.

As illustrated in FIG. 1, in one preferred embodiment of the present invention, the racket face 15 has a rectangular shape with opposite sides being parallel and equal in length. The width of the racket face 15 is chosen to be 12", the length of the racket face 15 is 14.5", and the length of the handle 5 is 8", so that the overall length of the racket is 28". As seen in FIGS. 2, 3 and 4, there are clearly other racket face shapes which will result in all of the longitudinal strings 20 of equal length and all of the transversal strings 25 of nearly equal length.

As seen in FIG. 2, the transversal sides of the racket face 15 curve upward. These sides remain parallel throughout their length so that the longitudinal strings 20 continue to all be the same length. The maximum bend of the transversal sides is chosen to be 1".This frame may be more visually appealing and easier to construct than the rectangular shaped frame.

As seen in FIG. 3, the sides of the racket face 15 curve slightly outward, having such a curvature so that the string tension brings the sides back to the straight and parallel position, or nearly so. All of the transversal strings 25 would not be of exactly the same length, but, if the curvature is sufficiently small, with a maximum bend less than 0.51", the affects of such small length inequalities is negligible.

As seen in FIG. 4, the transversal sides of the racket face 15 curve downward. These sides remain parallel throughout their length so that the transversal strings 25 continue to all be the same length. The resultant racket face 15 includes more of the optimal hitting surface.

Figure 5:
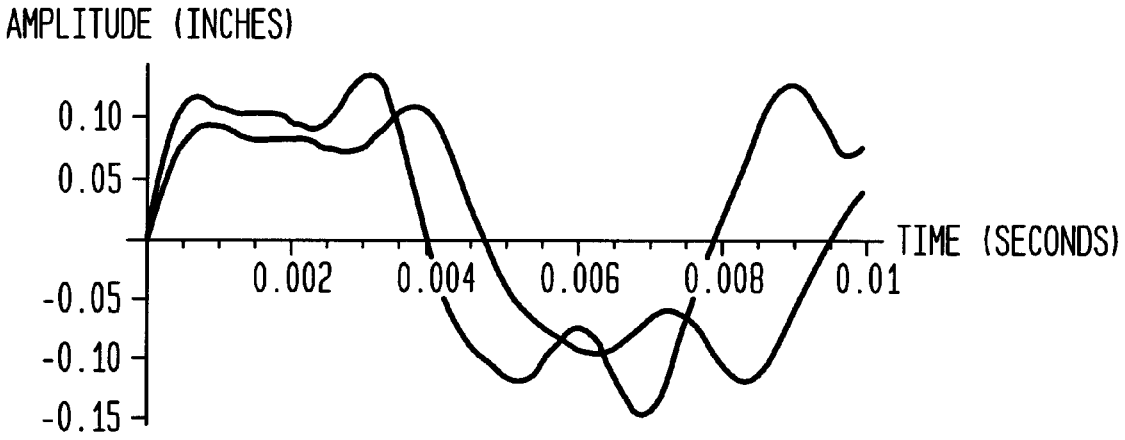
FIG. 5 depicts the response of two strings, one of length 12" and the other having a length of 14", on a tennis racket when they are struck by a tennis ball.

Since the longitudinal strings 20 and transversal strings 25 are all the same length, they will vibrate at the same frequency and will respond identically. A ball struck almost anywhere on the racket face 15 will encounter the same grid of strings and will therefore respond with the maximum degree of uniformity. As an illustration, the graph in FIG. 5 depicts the response of two strings, one 12" in length and the other 14" in length, on a tennis racket when they are struck by a tennis ball. The strings vibrate with different frequencies, so that the combined effect produces a less-than-optimal ball rebound speed. If the length of the second struck string were the same as the first, then the responses would be in phase and so the combined effect would produce a greater ball rebound speed, as provided by the present invention.

The uniform string structure of the present invention provides an advantage for central impacts as well as non-central impacts. The speed of a hit ball depends not only on the strings near the impact area, but, to some extent, on all of the strings of the racket. The impact with the ball sets up a vibration pattern that spreads out from the impact area to the frame and back. The uniform string structure of the present invention leads to a more unified propagation of these vibrational waves, and to a consequent more powerful response. In addition, the longer string lengths of the present invention cause the strings to deflect more and the ball to compress less, leading to a greater return of energy to the ball. The present invention's constructive interference of strings that vibrate with the same frequency gives rise to the best possible ball rebound speed for all impact locations.

The uniform string structure of the present invention provides for the ability to select different tensions and/or mass densities for the transversal strings 25 and the longitudinal strings 20 so that all of the strings on the racket face 15 vibrate with the same frequency. The vibrational frequencies can be made equal by choosing the appropriate tension to mass ratio for the transversal strings 25 and for the longitudinal strings 20. The result will be a racket all of whose strings vibrate with the same frequency.

Figure 6:
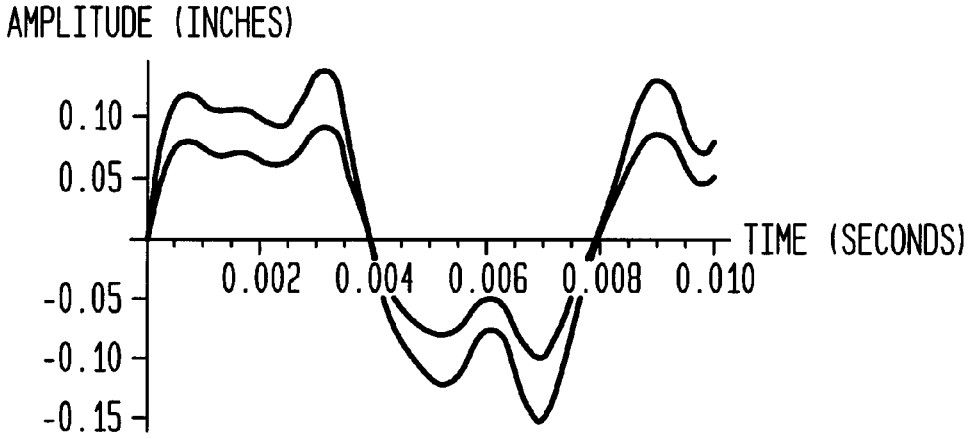
FIG. 6 depicts the response of two strings, of different lengths but having equal frequencies, on a tennis racket when they are struck by a tennis ball.

For example, if two strings of different length are given different tension values and/or mass values, such that the frequencies are equal, the response of the strings, as represented in FIG. 6, are now in phase. The combined effect is optimal.

Figure 7:
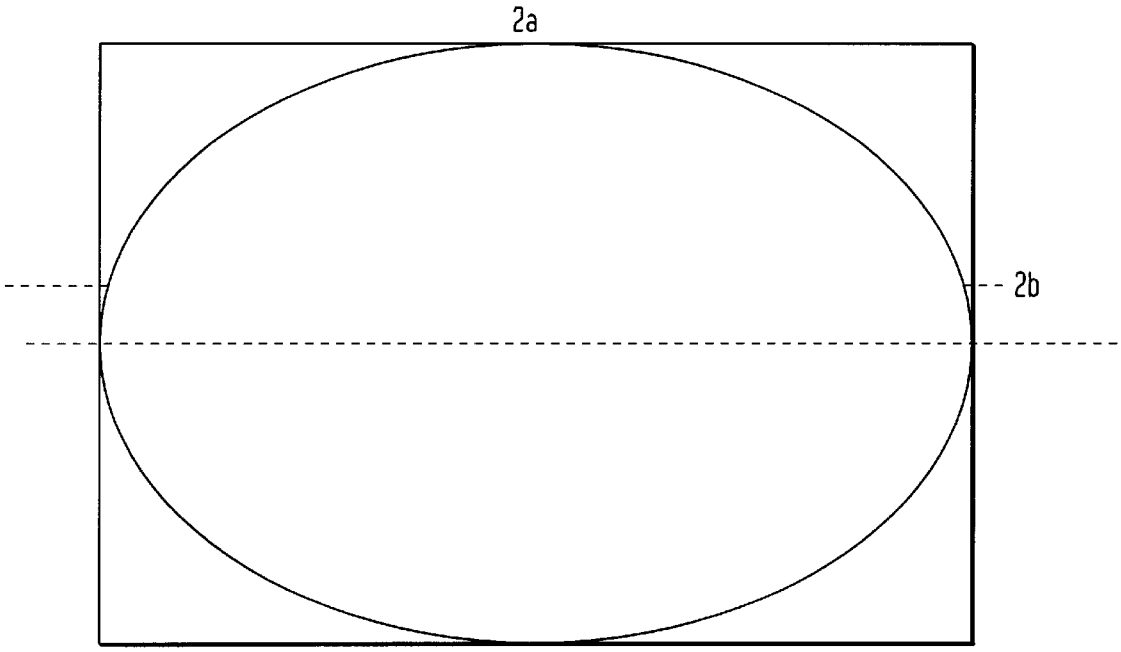
FIG. 7 illustrates the comparison of the area of an elliptical face and a rectangular face of the same width and length.

The present invention provides two geometrical advantages over a conventional racket, larger racket face 15 area and greater moment of inertia. To quantify these advantages, consider a conventional ellipsoidal racket face and a rectangular shaped racket face of the same width and length, as shown in FIG. 7. The rectangular racket face has over 27% more area than the ellipsoidal racket face. In a preferred embodiment of the present invention, having a rectangular shaped racket face 15, there will result a greater surface area for the ball to impact. The present invention will produce more hits and better hits. The present invention will produce acceptable hits in areas where the conventional racket completely misses the ball, and it will produce good hits in areas where the conventional racket produces bad hits.

The greater area of the racket face 15 of the present invention leads to longer strings at non-central locations. With a conventional racket, when a ball impact is off-center, in either the transversal or longitudinal direction, the string deflections are not symmetrical. The ball rebounds with an angular deflection error. It is obvious that the longer the strings are that are encountered by a ball, the smaller the angular deflection error. Therefore, the present invention, having longer strings, will reduce the angular deflection error.

Figure 8:
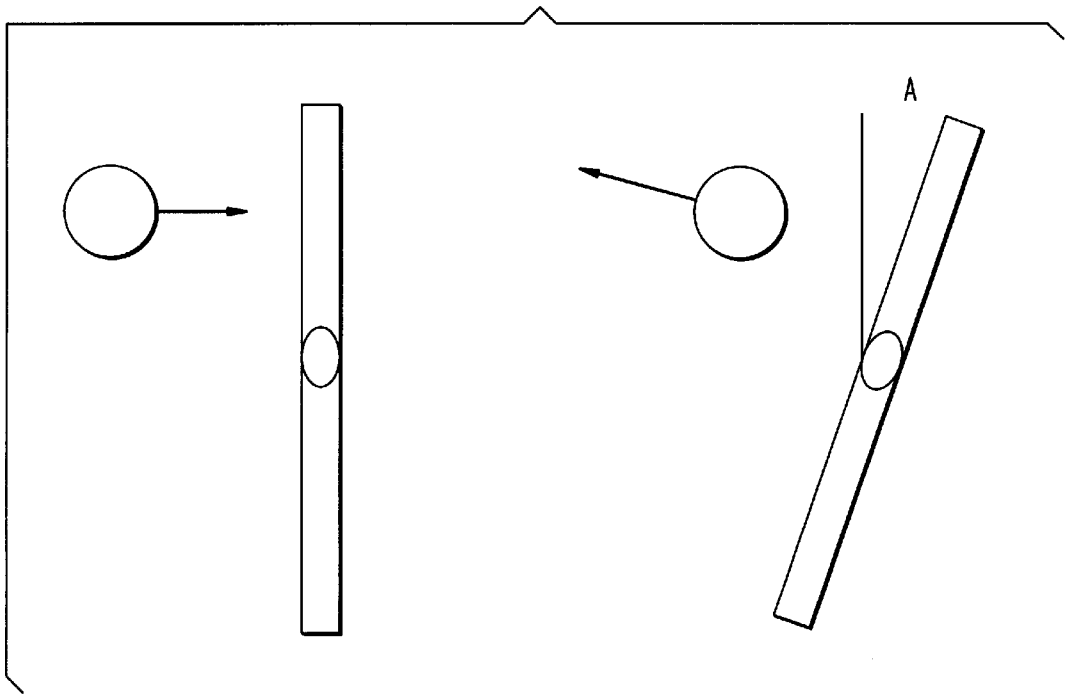
FIG. 8 illustrates the backward rotation of a racket away from the ball during impact.

Further, the moment of inertia of the present invention, having a rectangular shaped head and face, is approximately 50% larger than the moment of inertia of an ellipse frame of equal weight. As seen in FIG. 8, in the left picture the tennis ball is approaching the racket from the left, several inches above the centerline. In the right picture, the ball is leaving the racket after the impact. The impacted racket is rotating clockwise as a consequence of the torque exerted by the ball. When the ball leaves the racket, the racket has rotated through an angle A relative to its initial direction, and this causes the ball to leave the racket face in a direction that is rotated relative to the incident direction. The large moment of inertia of the present invention renders the angle A, the racket rotation angle, and the ball's angular deviation, to be relatively small. Since the moment of inertia of the present invention is 50% greater than that of conventional rackets, the present invention will rotate away from the ball 50% less than will conventional rackets of equal weight. The error introduced in the ball's rebound direction will consequently be approximately 50% less. Numerically, A is about 4.5 degrees for a good ground stroke impacted 3" from the centerline with a conventional racket. For the same hit with the present invention, A is reduced to approximately 3 degrees.

The reduced rotation of the present invention, in addition to performance benefits, also will reduce "tennis elbow" and related injuries, as the twist of the racket frame is believed to be a major contributor in these injuries.

Computer modeling provides further support for the improvements and objects of the present invention. First, the ball has been modeled. The equations describing the perpendicular impact of a ball (which meets USTA specifications) on a rigid wall (an incompressible and infinitely heavy flat surface) have been solved by computer. The results provide a complete description of the position, shape and velocity of a ball, at all times during impact, as represented in Table 1 below. The first column gives the impact speed, which is chosen to range from 20 to 100 mph. The second column gives the corresponding maximum inward compression distance of the ball in inches, the third column gives the total time (in milliseconds) during which the ball is in contact with the surface (the impact time, or dwell time), and the final column gives the ratio of ball rebound speed to impact speed. This velocity ratio ("VR") is the coefficient of restitution ("COR") of the ball at the given impact speed. This important quantity has been normalized to 0.75 at the impact speed of 15.7 mph.

TABLE 1

BALL IMPACTS ON RIGID SURFACE

| Imp Speed (mph) | Ball Compr (in) | Imp Time (ms) | Vel Ratio VR |
|---|---|---|---|
| 20 | 0.394 | 3.437 | 0.743 |
| 40 | 0.673 | 2.965 | 0.705 |
| 60 | 0.928 | 2.729 | 0.692 |
| 80 | 1.155 | 2.580 | 0.678 |
| 100 | 1.362 | 2.453 | 0.667 |

These data reveal the expected results that, as the impact speed increases, the ball's maximum compression increase, the impact time decreases, and the VR decreases. There have been no previous accurate theoretical or experimental determinations of these quantities at these speeds.

Further, the tennis racket has been modeled for the case when the racket face is rigidly clamped to stationary flat surface. The equations describing the perpendicular impact between this racket face and the ball solved by computer, providing a complete description of the motions of the ball and racket for all times during the impact. The only relevant information about the racket is the string tension T, the string mass per unit length M, and the (essentially rectangular) shape of the string boundary (the inside perimeter of the face). The initial conditions are that the strings are at rest and the ball strikes the racket at t=0 at a specified point on the face with a specified velocity v.

Figure 9:
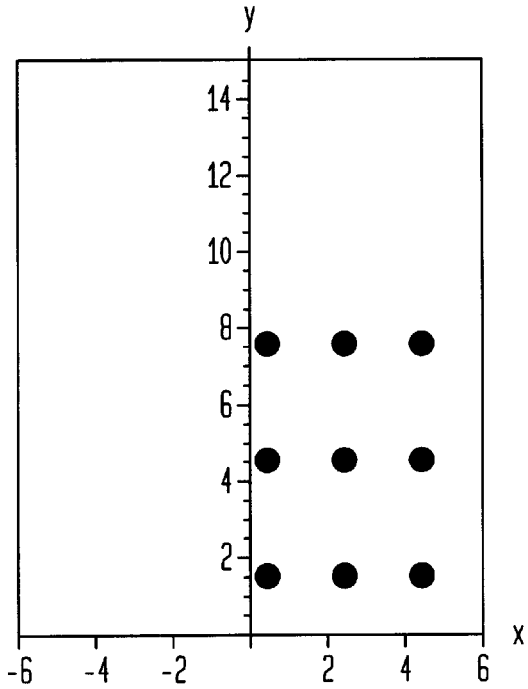
FIG. 9 represents a graph of impact points on a racket face in which the racket is rigidly fixed.

To specify positions on the rectangular racket face 15, the coordinate system shown in FIG. 9 was used. The origin is at the center of the lower horizontal (short) face segment and the x-axis runs along this segment. The y-axis runs in the vertical (long) direction in the center of the racket face 15. Assume that at t=0 the ball strikes the racket face 15 with a given speed v, at a point (x,y) where two strings cross. The subsequent motion of the strings and the ball is then completely determined by the equations of motion, solved by computer. All of the dynamics, including the compression of the ball as it spreads out on the strings and the deflection of the strings, is thus predicted. Some of the results of these calculations are given in Table 2.

First, consider impacts at the nine points indicated by dots in FIG. 9 of the racket face 15. Because the frame is rigidly fixed, the results are symmetric about the y axis and about the horizontal centerline y=7.5. It is therefore only necessary to consider impacts in the lower right quadrant of the face. Some of the results of these impacts are given in the following tables. Table 2 represents the calculated ball velocity ratio (VR) at each of the coordinates (x=0.5, 2.5, and 4.5 inches and y=1.5, 4.5, and 7.5 inches) in the case when the impact speed is 80 mph, the string tension is 60 pounds, and the distance between adjacent strings is 0.5 inches. (In the game situation, the impact speed is the relative speed between the ball and the racket, e.g., a ball speed of 30 mph and a racket speed of 50 mph.) This VR, the ratio of the rebound speed of the ball immediately after the impact to the incident speed of the ball immediately before the impact, is not the COR between the ball and racket. (The COR is the ratio of the rebound and incident relative speeds for a ball impacting on a free racket.).

TABLE 2

| VELOCITY RATIOS ON FIXED RACKET | | | |
|---|---|---|---|
| vertical | horizontal position | | |
| position | x = 0.5 | x = 2.5 | x = 4.5 |
| y = 7.5 | 0.863 | 0.825 | 0.770 |
| y = 4.5 | 0.868 | 0.835 | 0.774 |
| y = 1.5 | 0.778 | 0.771 | 0.749 |

These VRs range from a maximum of 0.87 near the center of the racket face 15 to a minimum of 0.75 near the corner of the racket face 15. These values are higher than those of conventional rackets, and the region of excellent performance (VR 0.80) is much larger than that of conventional rackets. The powerful and uniform response provided by this racket is thus confirmed.

Figure 10:
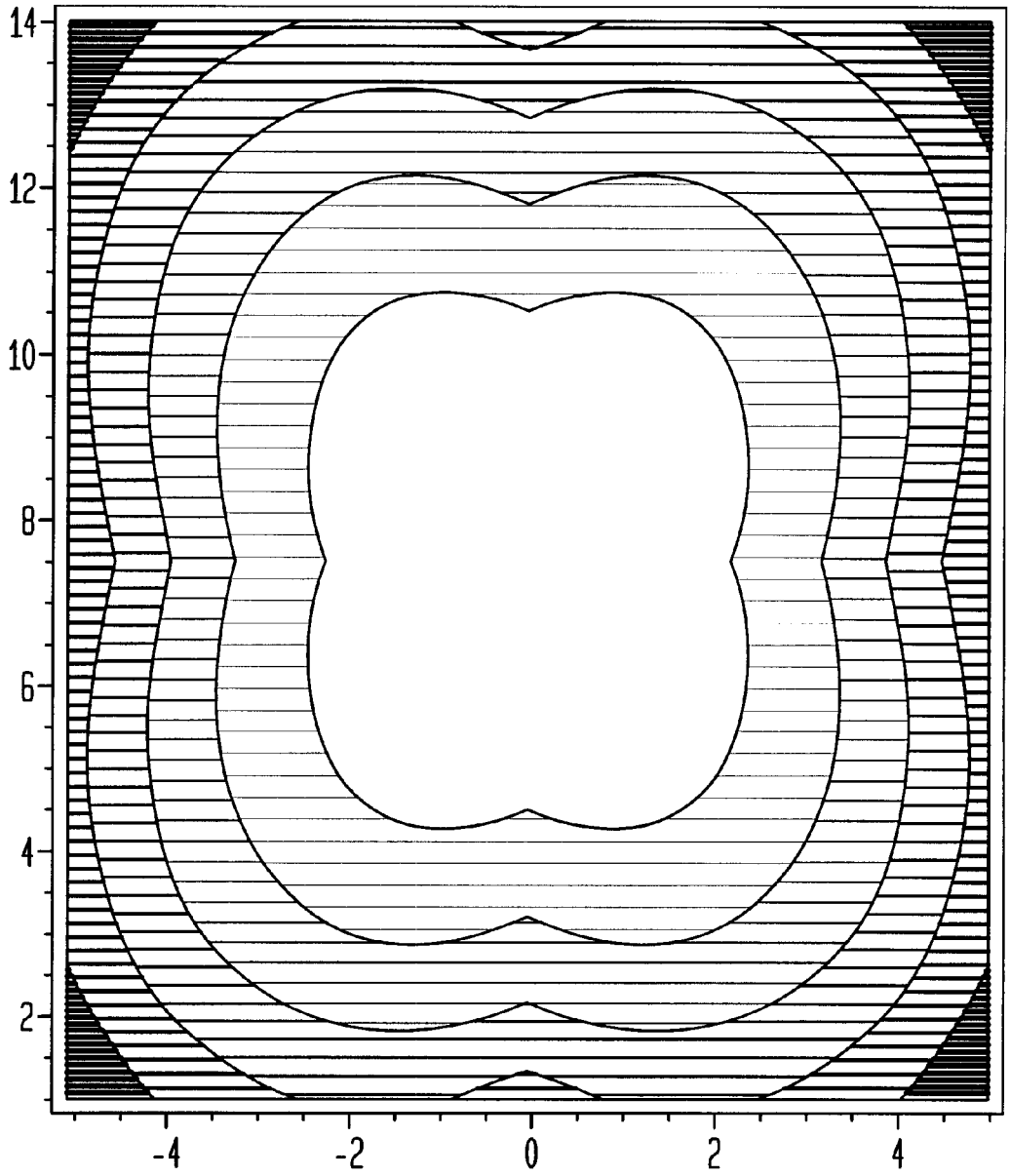
FIG. 10 is a contour plot of the racket face illustrating the VR data of the present invention with a fixed frame.

FIG. 10 illustrates the above VR data more clearly on a contour plot of the racket face 15. The (lightest) central area is the region with VR greater than 0.85. The increasingly darker subsequent outer rings correspond respectively to regions with VRs in the ranges 0.83–0.85, 0.81–0.83, 0.79–0.81, and 0.77–0.79. The darkest outer region corresponds to VRs less than 0.77. The racket face area within one inch of the frame is not shown because balls that impact in this area touch the frame. The sweet spot of this clamped racket, comprising the central region plus the three adjacent rings, is seen to comprise almost the entire racket face 15, which remains true for the hand-held racket. Note that, although the racket face region near the frame is an area of lower performance, this region cannot be eliminated, rendering the racket face to be more elliptical, without reducing performance on the rest of the racket face and reducing the MOI.

Figure 11:
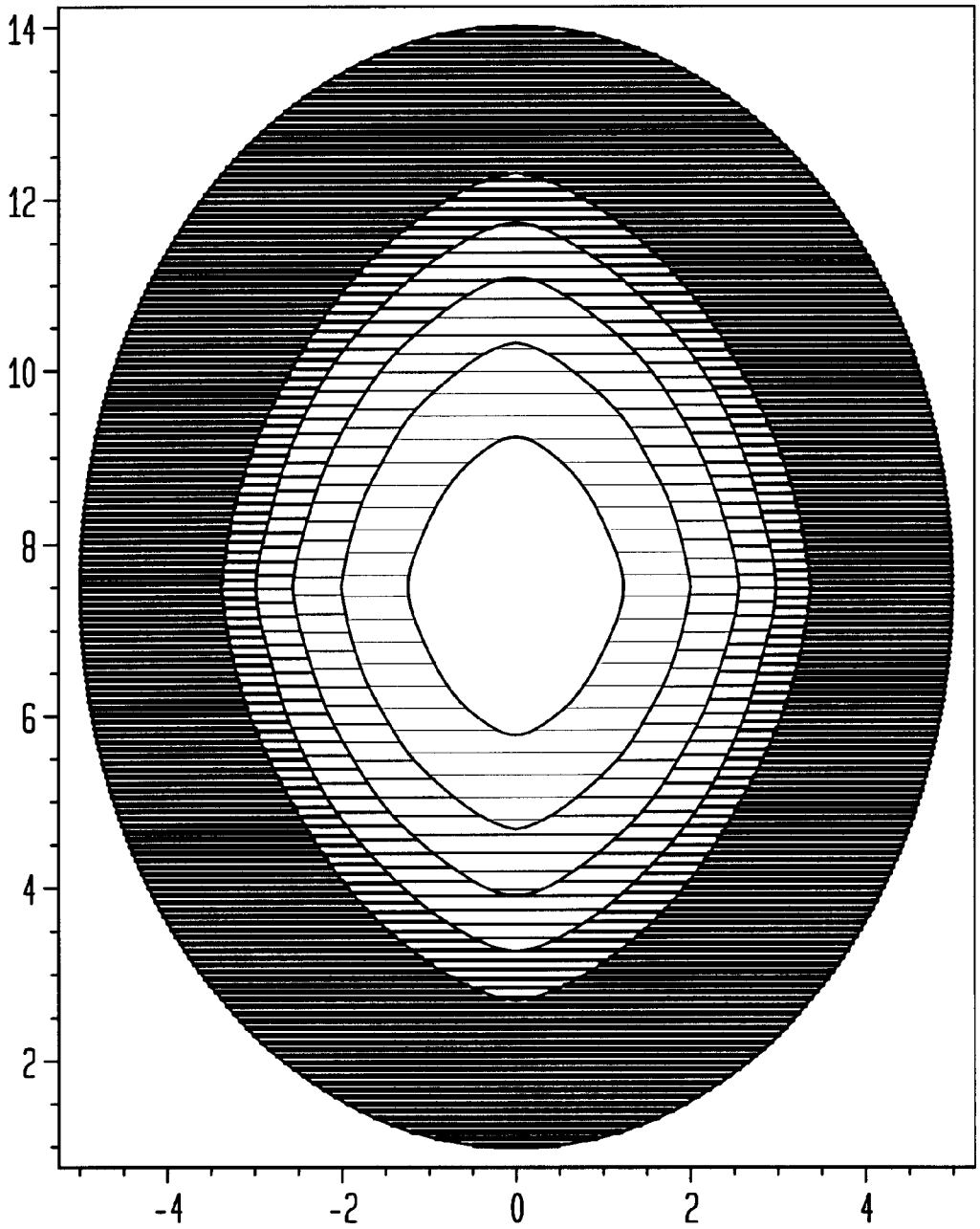
FIG. 11 is a contour plot of the racket face illustrating the VR data of a conventional racket with a fixed frame.

When the fixed frame VRs are similarly calculated for a conventional racket with an elliptical frame, it is seen that the overall best performance, and especially the performance for off-center hits, is significantly reduced. The VR contour plot for the conventional racket of the same width, length, and string tension, and for the same ball and impact speed, is provided in FIG. 11. The region within 1' of the frame is excluded as before. The contour lines correspond to the same VR values as in the plot for the present invention given above. Now the maximum VR is reduced from 0.87 to 0.86, the size of the central best-performance region, with VR>0.85, is greatly reduced, as is the size of each of the outer regions. The size of the low-performance (darkest) outer region, corresponding to VR<0.77, is greatly increased. The sweet-spot area, with VR>0.79, which comprised most of the racket face of the present invention, is now reduced to a relatively small region. The superiority of the present invention is thus clearly exhibited.

The above VR data, along with additional results, are given in Table 3. The x and y coordinates of the impact points are given in the first two columns. The maximum string deflection is given in the third column. The maximum ball compression distance is given in the fourth column, the total impact time is given in the fifth column, and the VR is given in the final column.

TABLE 3

| BALL IMPACTS ON FIXED RACKET | | | | | |
|---|---|---|---|---|---|
| Impact Point | | String Defl | Ball Compr | Imp Time | Vel Ratio |
| x (in) | y (in) | (in) | (in) | (ms) | VR |
| 0.5 | 1.5 | 0.196 | 1.121 | 2.772 | 0.778 |
| 0.5 | 4.5 | 0.330 | 1.039 | 2.928 | 0.868 |
| 0.5 | 7.5 | 0.333 | 1.018 | 3.089 | 0.863 |
| 2.5 | 1.5 | 0.185 | 1.128 | 2.749 | 0.771 |
| 2.5 | 4.5 | 0.296 | 1.087 | 2.915 | 0.835 |
| 2.5 | 7.5 | 0.296 | 1.066 | 2.968 | 0.825 |
| 4.5 | 1.5 | 0.145 | 1.128 | 2.720 | 0.749 |
| 4.5 | 4.5 | 0.196 | 1.114 | 2.779 | 0.774 |
| 4.5 | 7.5 | 0.196 | 1.100 | 2.794 | 0.770 |

The string deflections are seen to range from 0.333 inches near the center of the face to 0.145 inches near the corner. The ball compressions range from 1.02' for impacts near the center of the face to 1.13' for impacts near the corner. (The ball diameter is 2.5".) It is expected that the more the strings deflect, the less the ball compresses, and so the less kinetic energy the ball looses, and so the greater is the VR. This expectation is clearly borne out by these data. The expected result that larger string deflections result in longer impact times is also confirmed.

Figure 12:
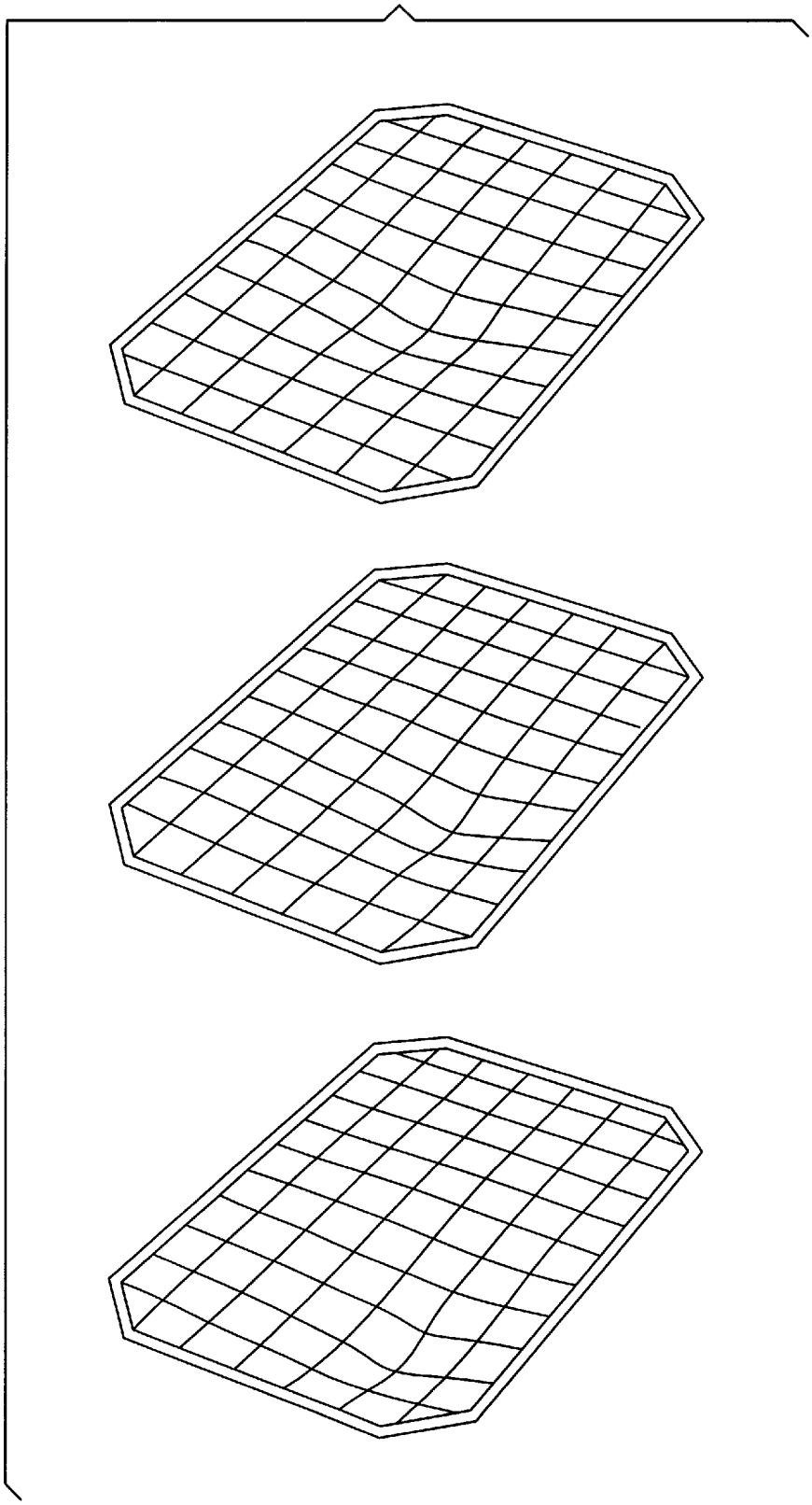
FIG. 12 illustrates the racket face at the times of maximum string deflection for impacts at three different locations on the racket face.
Figure 13:
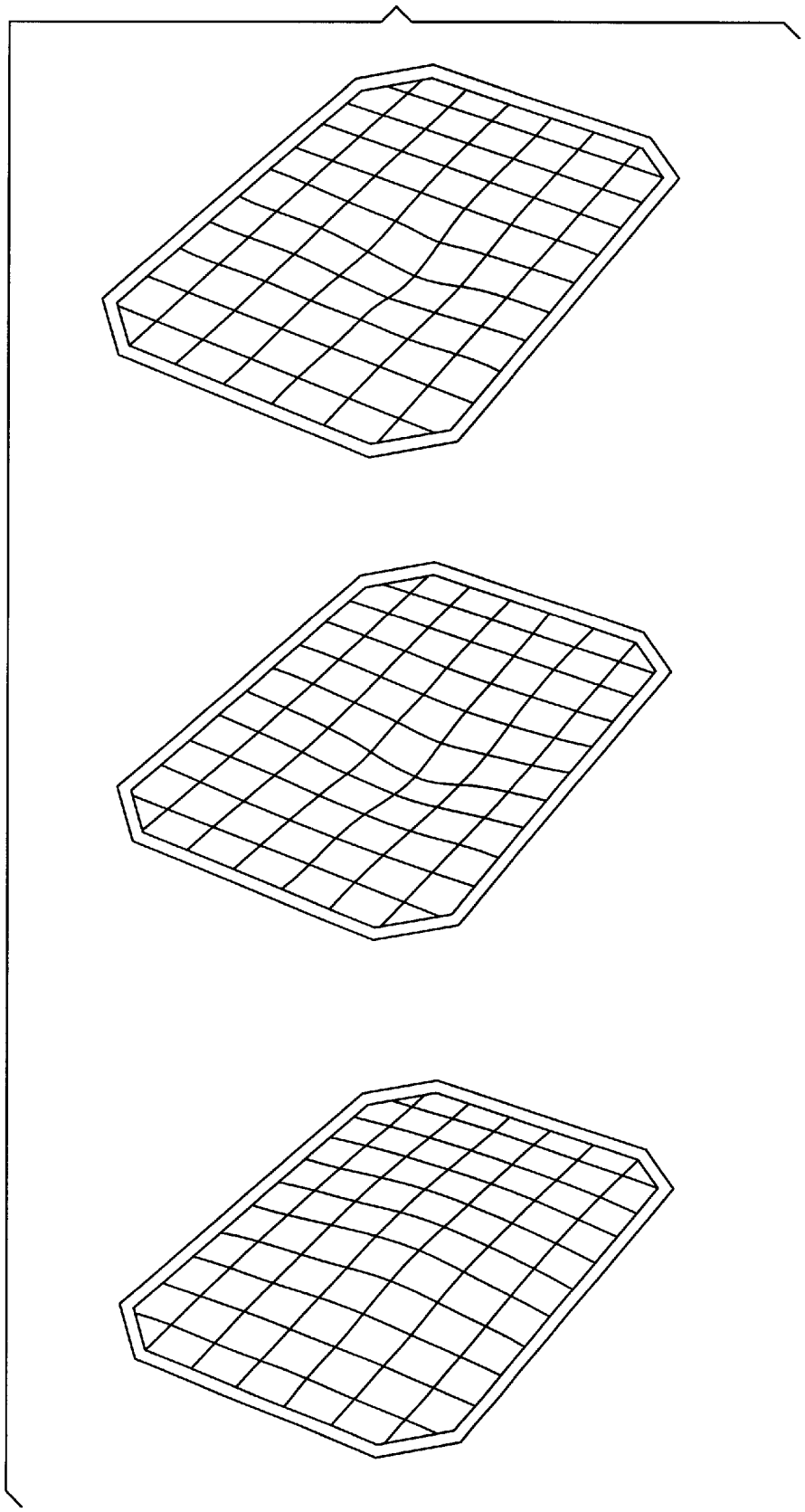
FIG. 13 illustrates the racket face at three different times during the impact, at one location.
Figure 14:
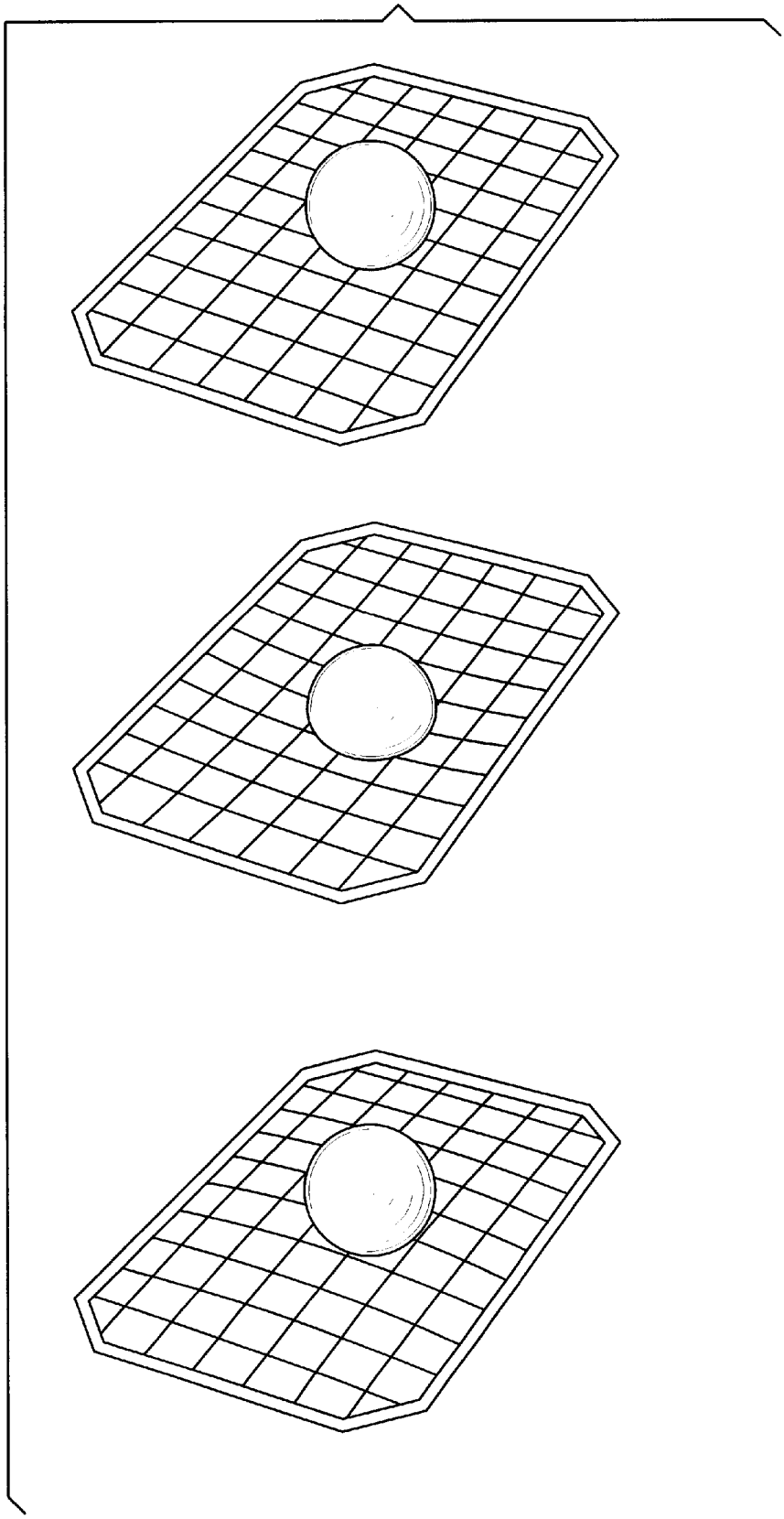
FIG. 14 illustrates the racket face at three different times during the impact, at one location, together with the state of the ball's compression at each time.

Computer generated pictures of some of the impacts are illustrated in FIGS. 12, 13 and 14. FIG. 12 shows the racket face 15 at the times of maximum string deflection for impacts at three different locations on the racket face. FIG. 13 shows the racket face 15 at three different times during the impact, at one location near the center of the face. FIG. 14 shows the same thing as in FIG. 13, together with the state of the ball's compression at each time. For clarity, not all of the strings are shown, and the ball is shown larger than scale.

All of the above results were obtained for an incident ball speed of 80 mph and a string tension of 60 pounds. It is of considerable interest to see how the details of the impacts change when the speed or the tension changes. The impact point will be fixed at the central point x=0.5, y=7.5. The data for fixed (60 pound) tension and variable ball speed is provided in Table 4, along with, for purposes of comparison, the previously given data for impacts on a rigid surface. For impacts on the fixed frame, the maximum ball compression, the maximum string deflection, and the VR are all seen to increase as the impact speed increases from 20 to 100 mph, whereas the impact time decreases. This VR trend is in contrast to the decrease of VR with increasing speed in the rigid surface impacts. At all speeds, however, the VRs are larger than those of any other racket at this string tension.

TABLE 4

| BALL IMPACTS ON RIGID SURFACE | | | | IMPACTS ON FIXED FRAME (Ten = 60 lbs) | | | |
|---|---|---|---|---|---|---|---|
| Imp Speed (mph) | Ball Compr (in) | Imp Time (ms) | Vel Ratio VR | Ball Compr (in) | String Defl (in) | Imp Time (ms) | Vel Ratio VR |
| 20 | 0.394 | 3.437 | 0.743 | 0.363 | 0.066 | 3.722 | 0.842 |
| 40 | 0.673 | 2.965 | 0.705 | 0.607 | 0.150 | 3.386 | 0.853 |
| 60 | 0.928 | 2.729 | 0.692 | 0.818 | 0.240 | 3.210 | 0.859 |

TABLE 4-continued

| BALL IMPACTS ON RIGID SURFACE | | | | IMPACTS ON FIXED FRAME (Ten = 60 lbs) | | | |
|---|---|---|---|---|---|---|---|
| Imp Speed (mph) | Ball Compr (in) | Imp Time (ms) | Vel Ratio VR | Ball Compr (in) | String Defl (in) | Imp Time (ms) | Vel Ratio VR |
| 80 | 1.155 | 2.580 | 0.678 | 1.018 | 0.333 | 3.089 | 0.863 |
| 100 | 1.362 | 2.453 | 0.667 | 1.204 | 0.430 | 3.012 | 0.868 |

The data for fixed (80 mph) incident ball speed and variable tension is represented in Table 5. As the tension increases from 50 to 70 pounds, the maximum ball compression, the maximum string deflection, the impact time, and the velocity ratio are all seen to decrease. Therefore, the racket becomes more powerful as the tension decreases. On the other hand, the maximum string deflection, and therefore the angular rebound error, increases as the tension decreases. Therefore, as also has been previously suggested, a decrease of control is the price paid for this increase of power with decreasing tension. At all tensions, however, the VRs reported here are larger than those of any other racket at this incident ball speed.

TABLE 5

| BALL IMPACTS ON FIXED FRAME (Vel = 80 mph) | | | | |
|---|---|---|---|---|
| Tension (lbs) | Ball Compr (in) | String Defl (in) | Imp Time (ms) | Vel Ratio VR |
| 50 | 1.279 | 0.354 | 2.844 | 0.923 |
| 60 | 1.259 | 0.295 | 2.757 | 0.860 |
| 70 | 1.252 | 0.250 | 2.695 | 0.815 |

With respect to fine tuning the racket, the tensions can be chosen differently in the transversal strings 25 and longitudinal strings 20 so that the string frequencies become equal. If the longitudinal strings 20 have length 1 and tension T, and the transversal strings 25 have length w and tension T', then the equal frequency condition is $T/T'=(1/w)^2$. This requires that the transversal strings 25 and longitudinal strings 20 have different tensions. There is a good reason to choose the transversal string 25 tension to be less than the longitudinal string 20 tension. As seen directly above, a decrease in tension leads to an increase in power together with an increase in angular rebound error. However, the angular rebound error from the transversal strings 25 is (at least patly) compensated for by the backward rotation of the racket. Since there is no such compensation for the angular rebound error from the longitudinal strings 25, it is clearly best to reduce transversal string tension. With 1=15" and w=12", the tension ratio T/T'=1.56. With T=70 lbs., this gives T'=45 lbs. With this choice, the 70 lb. tension VR of 0.815 increase to 0.925, with no loss of control. All of the above results were obtained for a string spacing of 0.5 inches.

The above fixed racket face data is the most appropriate for making comparisons between the new class of rackets and conventional ones. This is because, when the face is clamped, only the face geometry and the string tensions are relevant to performance and so comparisons can be made under equal boundary conditions. The other racket characteristics (weights, moments of inertia, frame rigidity, etc.), that in general also effect performance, can be chosen independently of the new features that have been introduced heretofore. The performance of the present invention under game conditions has also been evaluated in the case when the ball impacts a free, instead of a clamped, racket at rest and in the case when the ball impacts a swinging racket. It should be noted that since these transformations are the same for all rackets with the same weight, etc., the fact that the present invention has superior performance at all locations in the clamped situation implies that it will continue to be superior at all locations in the game situation.

It is well established that a free and a hand-held racket behave the same during an impact with a ball. In considering the perpendicular impacts of a regulation tennis ball onto a typical new racket that is at rest and free, it will be assumed that the rectangular racket face 15 has interior dimensions 12" by 15" as above. The other relevant racket characteristics are chosen as follows. The racket weight (W) is 14 ounces. The center of mass (COM) is located at the center of the edge of the racket face 15 above the handle 5. The MOI ($I_0$) about the horizontal axis (y=0) parallel to this edge through the COM is 800 ounce-inch-squared. For numerical convenience, these MOI units are based on weight instead of mass. The MOI value is thus the product of the conventional value and the acceleration of gravity. The MOI (I) about the long central longitudinal racket axis (x=0) is 200 ounce-inch-squared.

In the clamped face case, the VR was relatively large and had only small variations across the racket face 15. With the racket free to move during the impact, smaller values and larger variations of the VR will arise for the following reasons. Part of the kinetic energy of the ball will now be transmitted into the backward translation of the COM of the racket. This will reduce the VR by an amount that is inversely proportional to the racket weight W. Part of the kinetic energy of the ball will now be transmitted into the backward rotation of the racket about the horizontal axis (y=0) through the COM. This will reduce the VR by an amount that is inversely proportional to the racket MOI Io, and that is directly proportional to the perpendicular distance (y) of the impact point from this axis. Part of the kinetic energy of the ball will now be transmitted into the backward rotation of the racket about the vertical axis (x=0) through the COM. This will reduce the VR by an amount that is inversely proportional to the racket MOI I, and that is directly proportional to the perpendicular distance (x) of the impact point from this axis.

Figure 15:
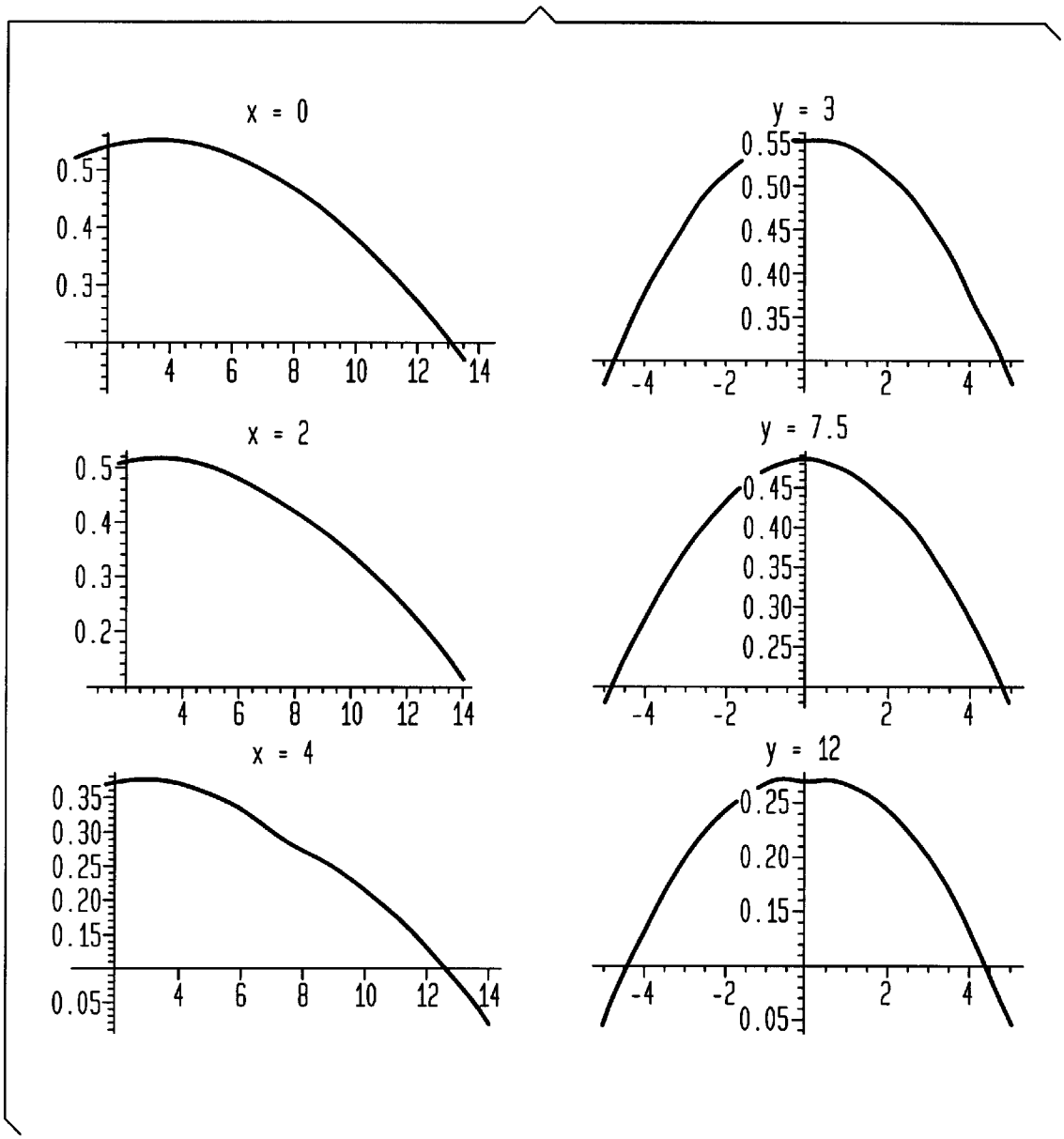
FIG. 15 illustrates VR behavior in relation to distance from the center.

For the clamped-face case, the VR=k(x,y) was maximal at the center of the racket face 15 (x=0, y=7.5) and slowly decreased in directions away from this center. When the above effects are taken into account, this behavior is modified such that the VR maximum is shifted downwards towards the COM (x=0, y=0) and the VR values tend to decrease with increasing distance y from the transversal axis and with increasing distance x from the longitudinal axis. This behavior is illustrated in the graphs in FIG. 15, which plot the VR along three vertical lines (x=0, x=2, x=4) and three horizontal lines (y=3, y=7.5, y=12). (From symmetry, the VR value at −x is the same as the value at x.) The maximum of the VR is seen to occur near the point (x=0, y=3).

Figure 16:
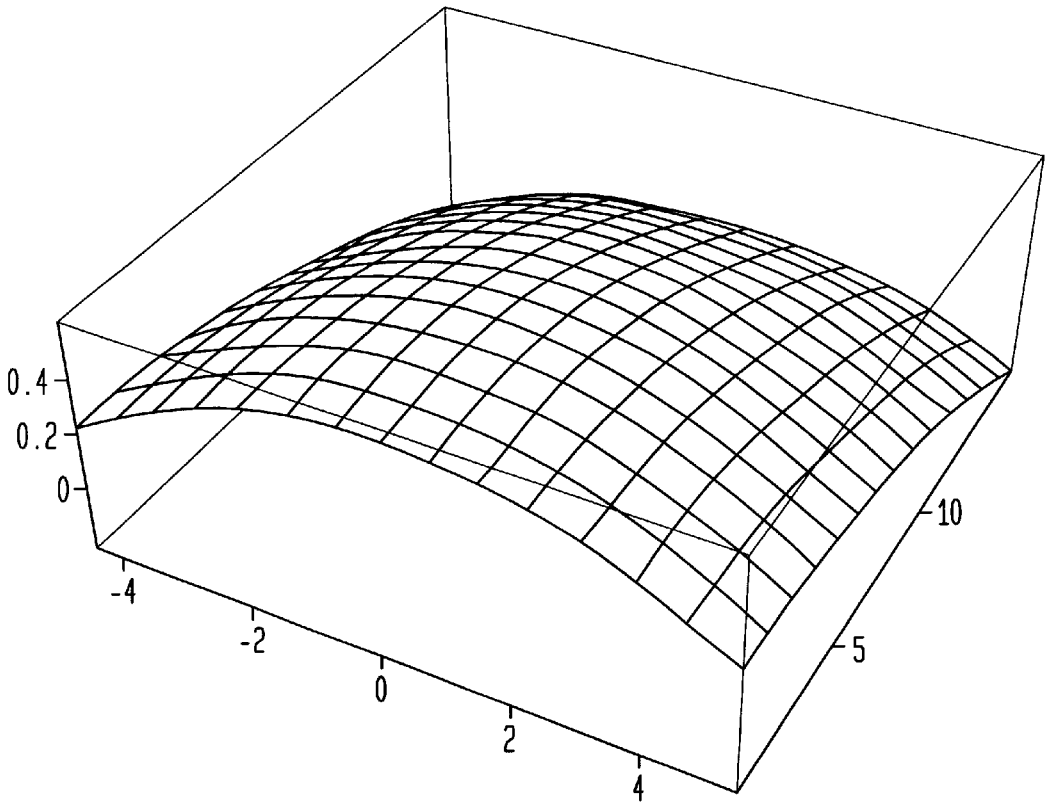
FIG. 16 is a three-dimensional graph of VR versus x and y, illustrating the VR behavior of the present invention.

The VR behavior is exhibited more clearly and completely by the three-dimensional graph of VR versus x and y in FIG. 16. The maximum near x=0, y=3, and the fall-off toward the edges are clearly seen.

Figure 17:
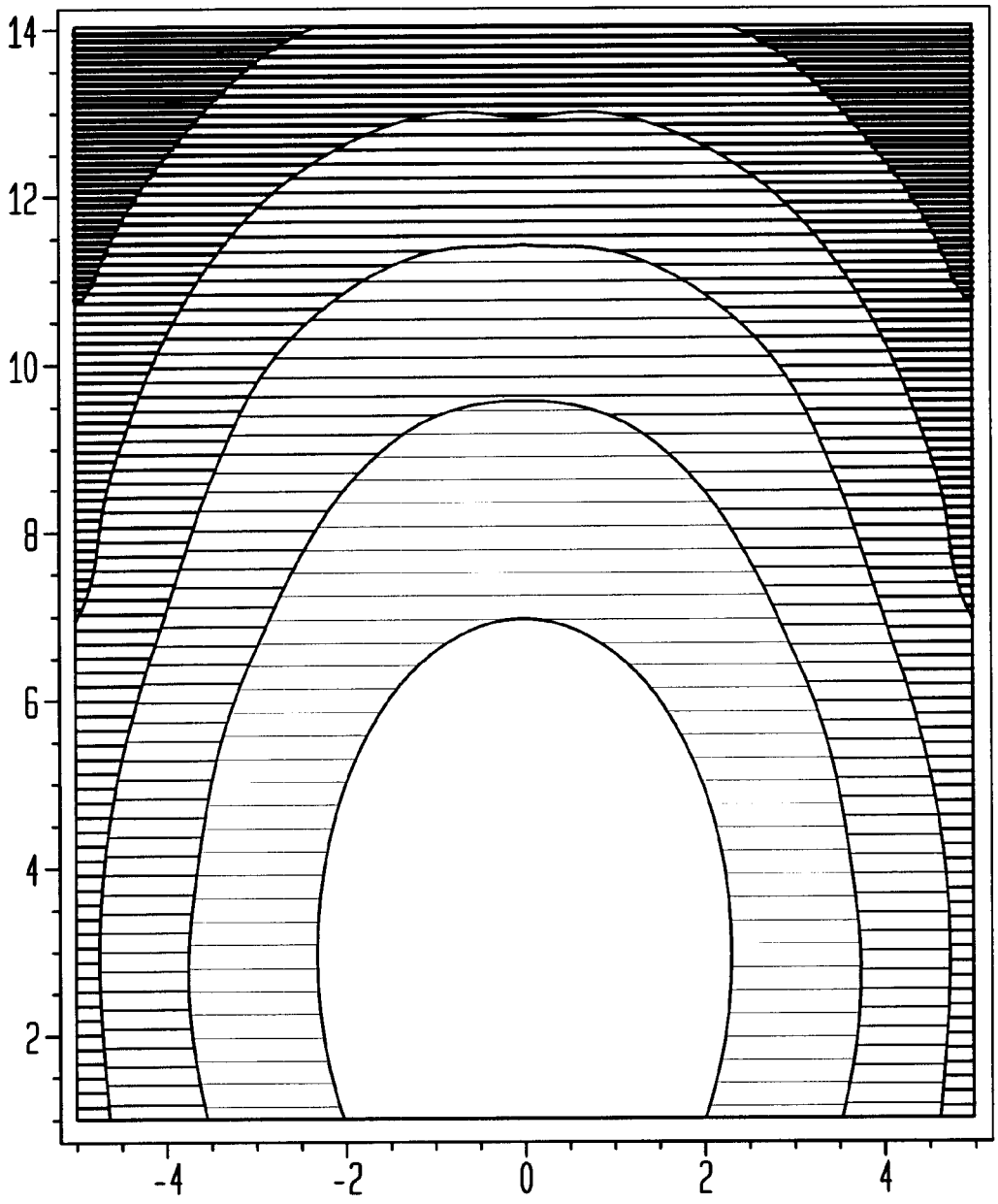
FIG. 17 is a contour graph illustrating the variation in the VR values across the racket face of the present invention.

Another way to illustrate the variation in the VR values across the racket face 15 is with the contour graph in FIG. 17. The (lightest) central area is the region with VR greater than 0.5. The increasingly darker subsequent outer rings correspond respectively to regions with VRs in the ranges 0.4–0.5, 0.3–0.4, 0.2–0.3, and 0.1–0.2. The darkest outer region corresponds to VRs less than 0.1. Each of these regions is significantly larger than the corresponding region of conventional rackets.

Figure 18:
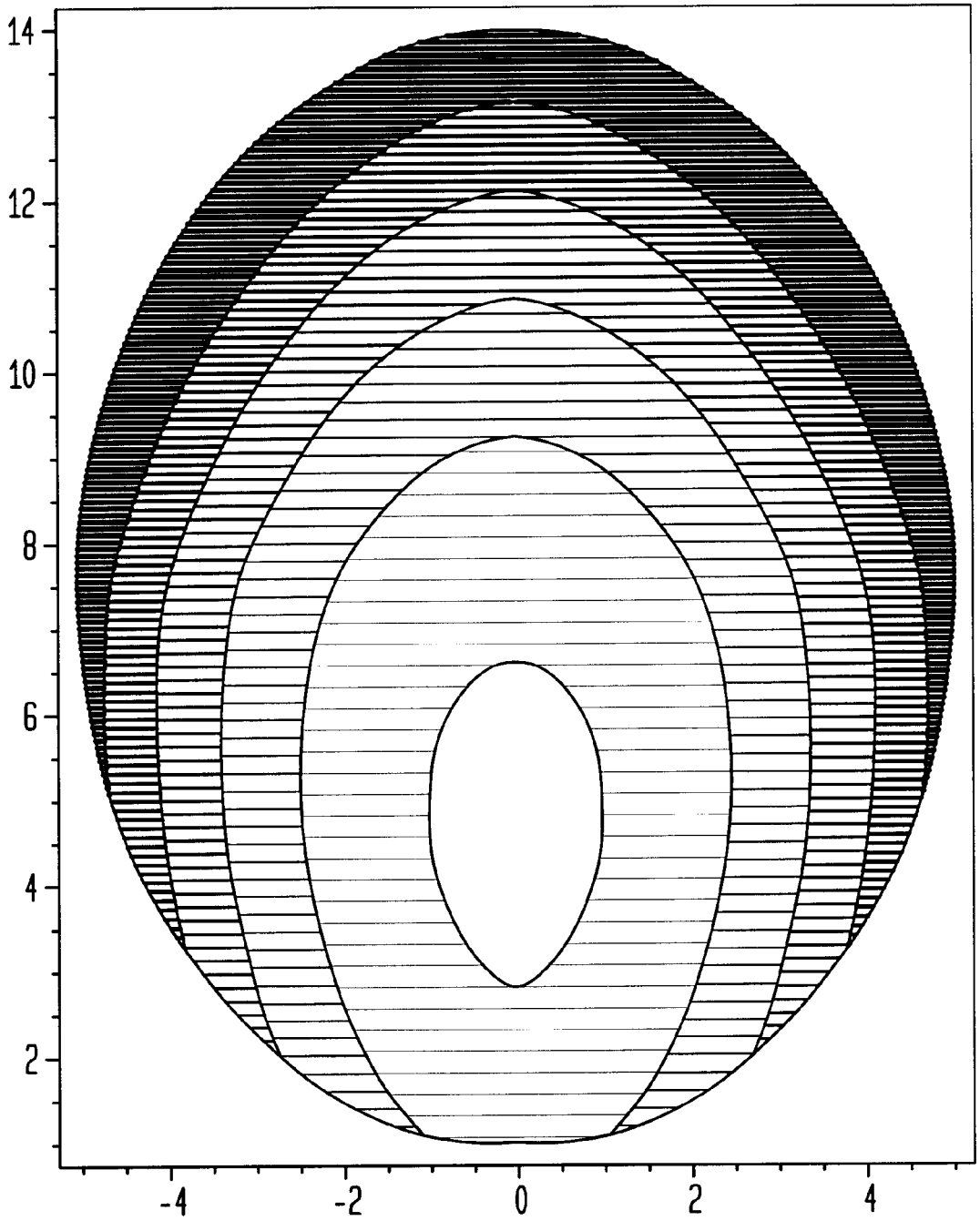
FIG. 18 is a contour graph illustrating the variation in the VR values across the racket face of a conventional racket.

When the free frame VRs are similarly calculated for a conventional racket with an elliptical face, but with the same weight and MOIs, it is seen in FIG. 18 that all of the corresponding contour regions are significantly reduced in length and especially in width. The (lightest) innermost region of best performance (VR>0.5) is now reduced to a small oval, and the (darkest) outer region of worst performance (VR<0.1) is now much larger. The superiority of the present invention is again clearly established.

To see how the above VR values translate to the hit ball speeds that the racket can deliver in a tennis game, it is only necessary to make a transformation from the above coordinate frame, with the racket at rest prior to the impact, to the tennis court frame, in which the racket is swinging towards the moving ball prior to the impact. To this end, consider the perpendicular impact between a ball moving with velocity v and the racket moving with velocity V(y) at the point of impact (x,y) on the face of the racket. In general, the racket velocity consists of a part that is translational, arising from the motion of the COM, and a part that is rotational, arising from the rotation of the racket about the horizontal axis y=0 through the COM. The translational part is independent of x and y, and the rotational part is proportional to y (but independent of x). The general expression for the velocity v'(x,y) of the ball as it leaves the racket is v'(x,y)=V(y)[1+k(x,y)]+v, where k(x,y) is the velocity ratio function described above (the VR for a free racket at rest prior to the impact).

Figure 19:
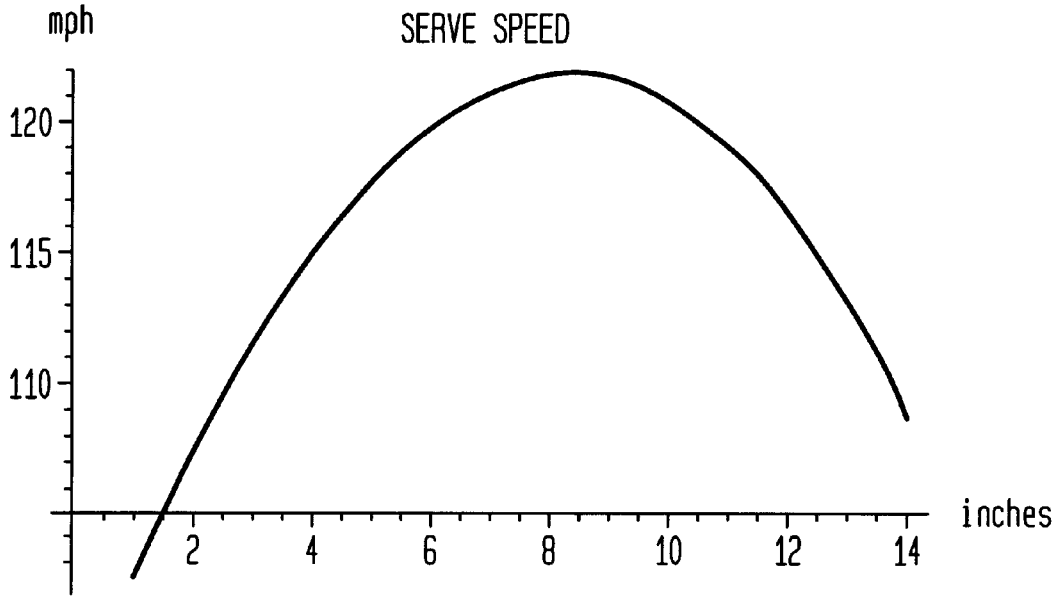
FIG. 19 is a graph of the serve speed versus y for the present invention.

The explicit form of the racket velocity function V(y) depends on the player's ability and his choice of stroke (forehand, backhand, serve, etc.). As a specific example, consider the first serve of a good player, with racket speed V(y)=±+2.25y, in mph. The racket speed is thus 65 mph at the COM (y=0), and nearly 82 mph at the center of the racket face (y=7.5). When this is substituted into the above equation (with incident ball speed v=0, appropriate to a serve), the hit ball speed v' is obtained for impacts at any point (x,y) on the face of the racket. The maximum of v' (the best place on the racket for this player to hit his serve) will be shifted upwards from the point (x==0, y=3) where the VR k is maximal, because the racket speed increases as y increases. The graph of the serve speed v'(0,y) verses y is provided in FIG. 19.

Figure 20:
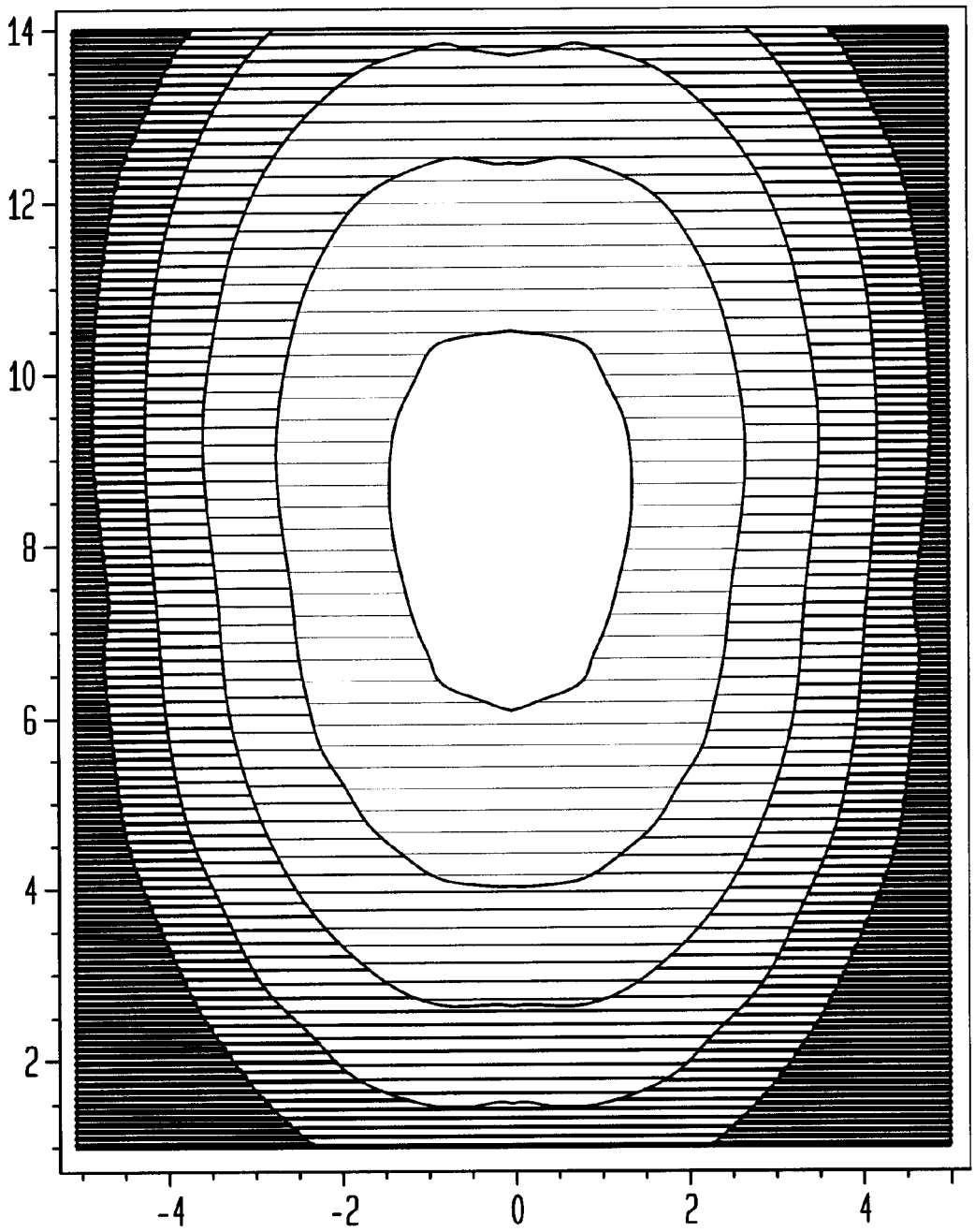
FIG. 20 is a contour graph illustrating the variation in hit ball speed values across the racket face for a typical serve with the present invention.

The maximum of the hit ball speed in this serve is seen to be 122 mph, obtained when the ball is struck at 8.3 inches above the lower edge of the frame. (Recall that the maximum of the VR occurred at 3 inches from this edge.) If the ball is struck off of the vertical centerline x=0, then the hit speed will be less than shown above because of the decrease of the VR function k(x,y) as x increases. The variation in the hit ball speed values across the racket face 15 is illustrated in the contour graph in FIG. 20. The (lightest) central area is the region with hit speed greater than 120 mph. The increasingly darker subsequent outer rings correspond respectively to regions with speeds in the ranges 115–120, 110–115, 105–110, and 100–105 mph. The darkest outer region corresponds to speeds less than 100 mph. Each of these regions is again significantly larger than the corresponding region of conventional rackets. The sweet spot region with speeds greater than 100 mph is now almost the entire racket face 15, and is centered near the geometric center of the face. The performance of this racket is exceptional, and can be increased even further using the fine-tuning techniques discussed above.

Figure 21:
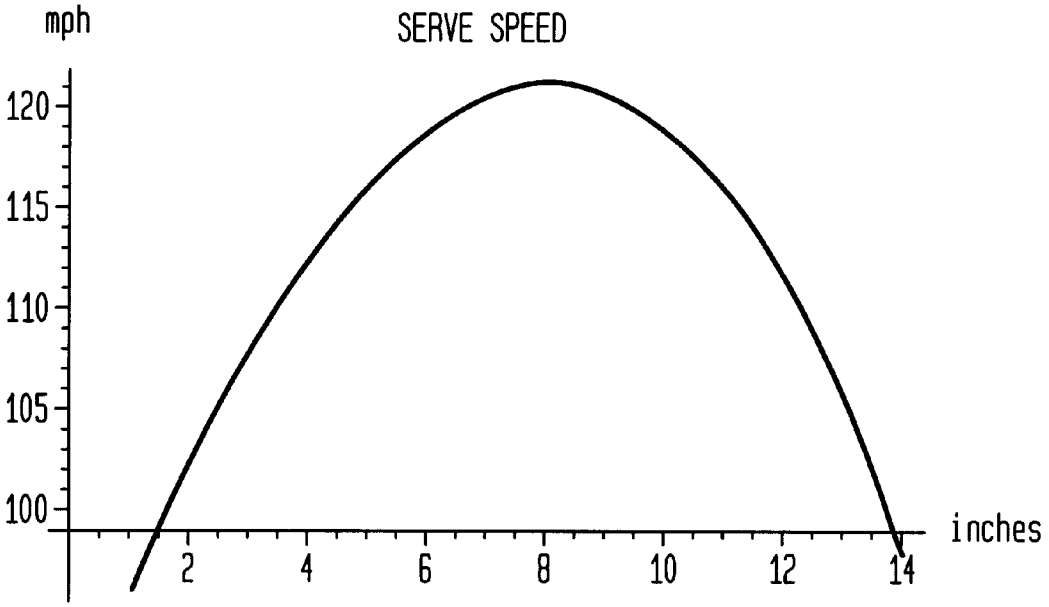
FIG. 21 is a graph of the serve speed versus y for a conventional racket.

For a conventional racket of the same face width, face length, tension, weight, MOIs, and for the same ball and service motion as above, the serve speed graph of v'(0,y) illustrated in FIG. 21 shows a reduced maximum speed (121 mph instead of 122 mph), and a much faster fall off from this maximum value.

Figure 22:
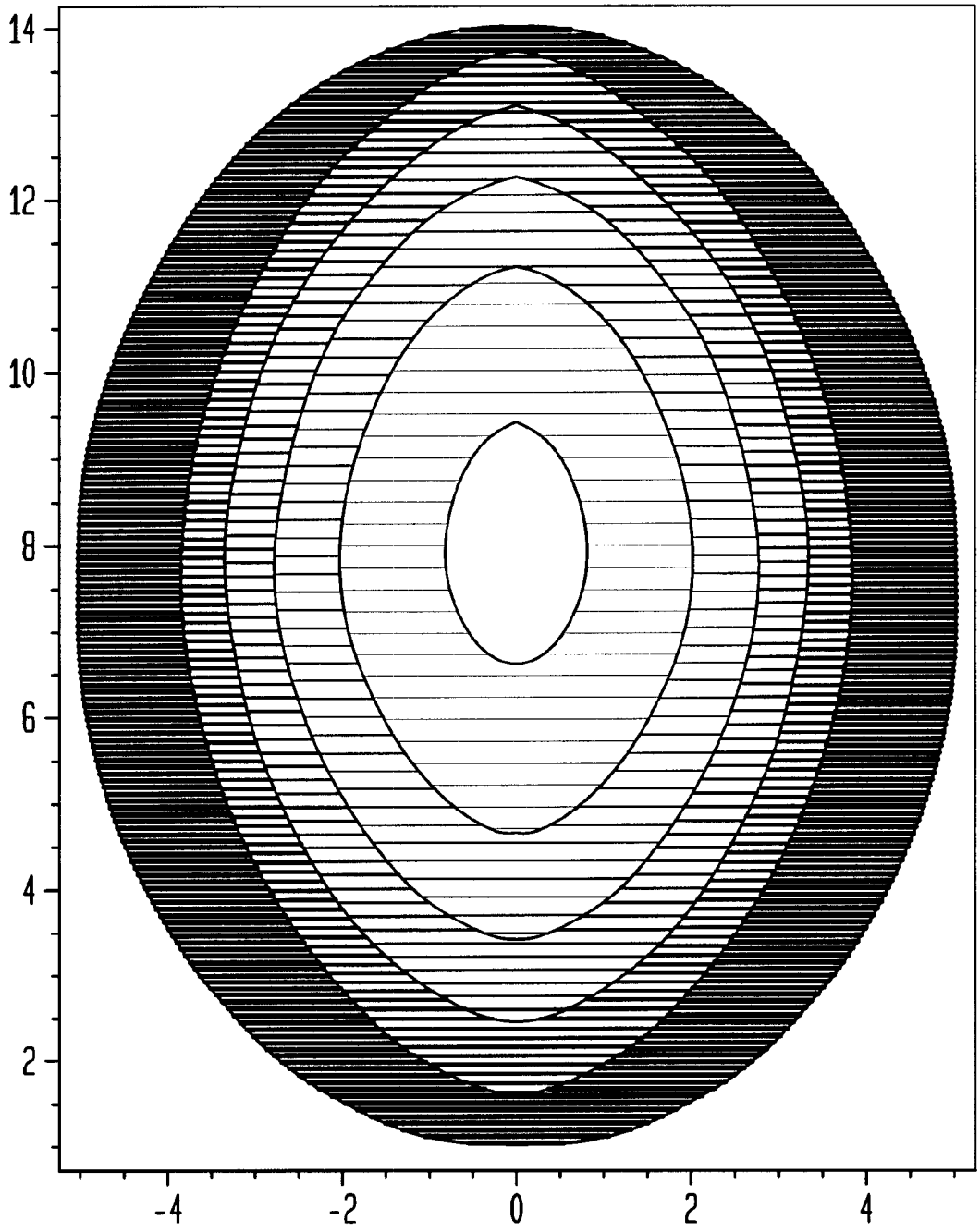
FIG. 22 is a contour graph illustrating the variation in the service speed for the conventional racket.
Figure 3:
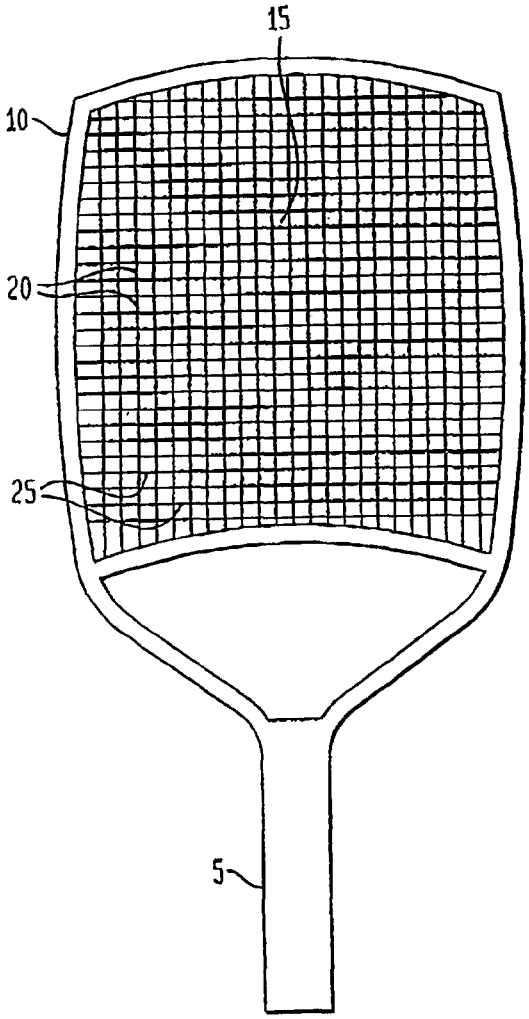
Figure 4:
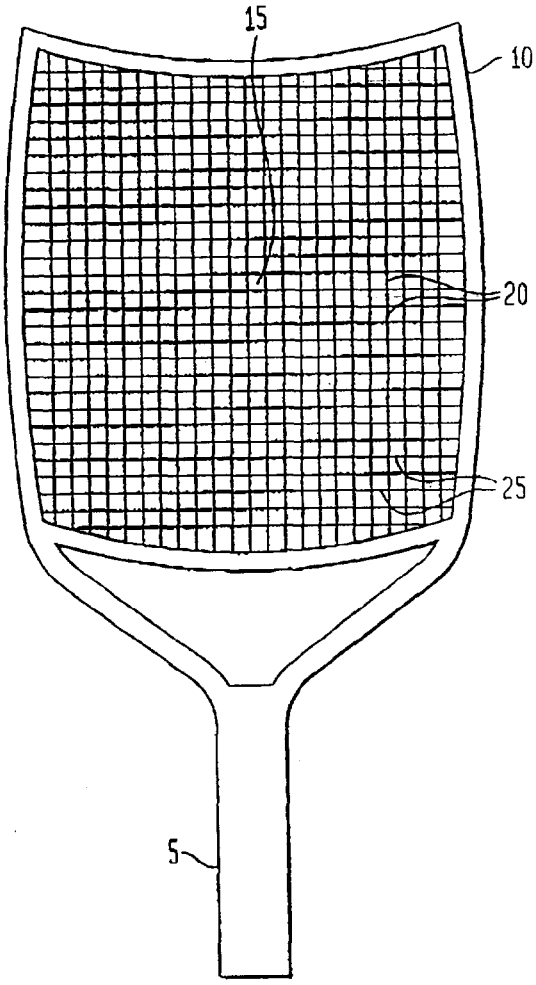
Figure 1:
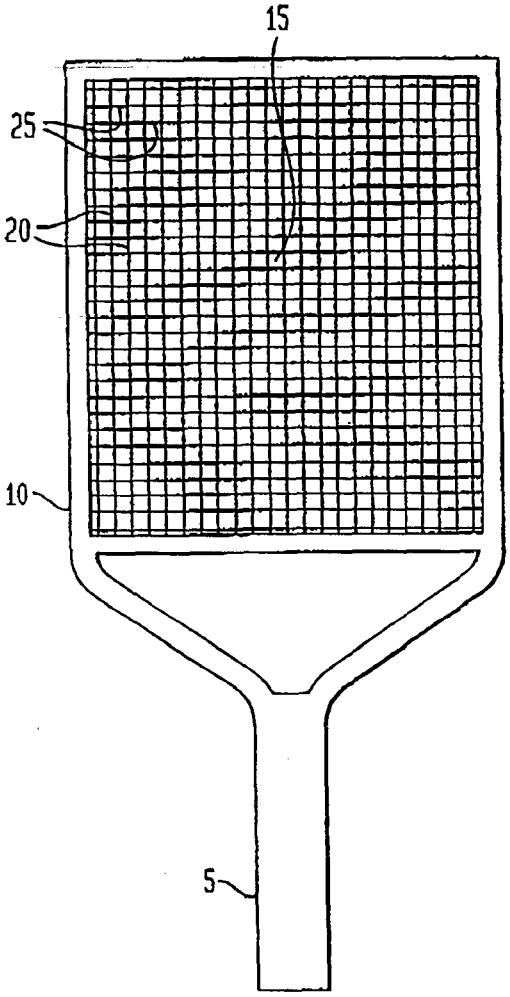
Figure 2:
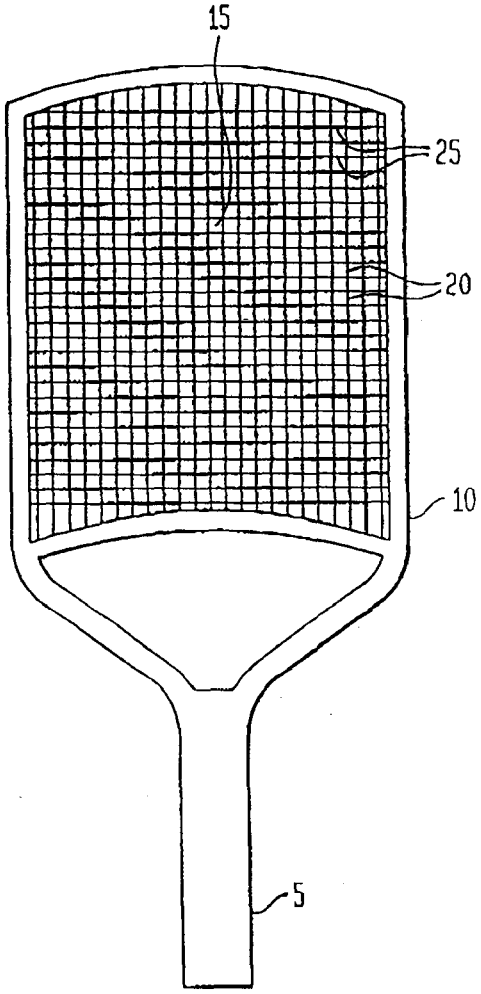

The service speed contour plot represented in FIG. 22 for the conventional racket also confirms the performance advantages of the present invention. The (lightest) central region with hit ball speed v'>120 mph, is now much smaller, as are the surrounding rings with contours v'=115, 110, 105, and 100 mph. The (darkest) outer region, with v'<100 mph is now much larger.

What is claimed is:

1. A racket comprising:

a frame with an elongated handle defining a longitudinal main axis;

a head connected to the elongated handle;

said head having parallel longitudinal sides and parallel transversal sides;

said head having a racket face, to be spanned by strings;

said head having a means for securing strings to the frame;

a plurality of transversal strings, all being of substantially identical length, running essentially parallel to each other and generally perpendicular to said longitudinal axis and secured to the frame;

a plurality of longitudinal strings, all being of substantially identical length, running essentially parallel to each other and parallel to said longitudinal axis and secured to the frame, the transversal strings and longitudinal strings together covering the entire racket face; and wherein the transversal sides of said racket face curve upward with the sides remaining parallel throughout their length so that said longitudinal strings continue to all be the same length.

2. The racket defined in claim 1, wherein the maximum curvature of the transversal sides of said racket face is 1".

3. A racket comprising:

a frame with an elongated handle defining a longitudinal main axis;

a head connected to the elongated handle;

said head having parallel longitudinal sides and parallel transversal sides;

said head having a racket face, to be spanned by strings;

said head having a means for securing strings to the frame;

a plurality of transversal strings, all being of substantially identical length, running essentially parallel to each other and generally perpendicular to said longitudinal axis and secured to the frame;

a plurality of longitudinal strings, all being of substantially identical length, running essentially parallel to each other and parallel to said longitudinal axis and secured to the frame, the transversal strings and longitudinal strings together covering the entire racket face; and wherein the transversal sides of said racket face curve downward and the sides remain parallel throughout their length so that said transversal strings continue to all be the same length.

* * * * *

UNITED STATES PATENT AND TRADEMARK OFFICE

CERTIFICATE OF CORRECTION

PATENT NO. : 6,344,006 B1
DATED : February 5, 2002
INVENTOR(S) : Richard A. Brandt It is certified that error appears in the above-identified patent and that said Letters Patent is hereby corrected as shown below:

Title page,
Delete the title page and substitute the attached title page.

Drawings,
Figures 1, 2, 3 and 4 are not numbered. Please substitute the following attached drawings.

Signed and Sealed this

Twenty-fifth Day of March, 2003

JAMES E. ROGAN
*Director of the United States Patent and Trademark Office*

(12) United States Patent
Brandt

(10) Patent No.: US 6,344,006 B1
(45) Date of Patent: Feb. 5, 2002

(54) SPORTS RACKET HAVING A UNIFORM STRING STRUCTURE

(76) Inventor: Richard A. Brandt, 69 Fifth Ave., Apt. 16A, New York, NY (US) 10003

( * ) Notice: Subject to any disclaimer, the term of this patent is extended or adjusted under 35 U.S.C. 154(b) by 0 days.

(21) Appl. No.: 09/715,762

(22) Filed: Nov. 17, 2000

(51) Int. Cl.[7] ..... A63B 49/02
(52) U.S. Cl. ..... 473/543
(58) Field of Search ..... 473/524, 532, 473/537, 540, 543, 539, 533, 534; D21/729

(56) References Cited

U.S. PATENT DOCUMENTS

| | | | | | |
|---|---|---|---|---|---|
| 1,536,255 | A | * | 5/1925 | Beal | 473/530 |
| 3,507,494 | A | * | 4/1970 | Finkel | 473/540 X |
| 3,734,499 | A | * | 5/1973 | Goldstein | 473/528 |
| 4,013,289 | A | * | 3/1977 | Kaminstein | 473/537 |
| 4,512,575 | A | * | 4/1985 | Tzeng | 473/537 |
| 4,566,695 | A | * | 1/1986 | Melby | 473/534 |
| 4,750,742 | A | * | 6/1988 | Coupar | 473/540 |
| 4,834,383 | A | | 5/1989 | Woehrle et al. | |
| 4,861,029 | A | * | 8/1989 | Takatsuka | 473/540 |
| 4,964,635 | A | * | 10/1990 | Fitzgerald | 473/521 |
| D339,394 | S | * | 9/1993 | Richards | D21/729 |
| 5,386,991 | A | * | 2/1995 | Rochette | 473/540 |

FOREIGN PATENT DOCUMENTS

| | | | | |
|---|---|---|---|---|
| DE | 3347426 | * | 1/1985 | A63B/51/12 |
| EP | 260208 | * | 3/1988 | 473/FOR 171 |
| FR | 2455906 | * | 1/1981 | 473/FOR 178 |
| GB | 2117253 | * | 10/1983 | 473/FOR 178 |
| NL | 8502294 | * | 3/1987 | 473/FOR 179 |

* cited by examiner

*Primary Examiner*—Raleigh W. Chiu
(74) *Attorney, Agent, or Firm*—Maxim H. Waldbaum

(57) ABSTRACT

A sports racket, for tennis and the like sports, has an elongated handle attached to a head having a racket face, which is spanned by a uniform string structure. The head has four sides, forming a non-elliptical shape, in which the opposite sides are substantially parallel. Longitudinal strings, all of which are substantially identical in length and run essentially parallel to each other, and transversal strings, all of which are substantially identical in length and run essentially parallel to each other and perpendicular to the longitudinal axis, span the racket face. The racket has a larger racket face than conventional rackets, while maintaining the length and weight measurements of conventional rackets, resulting in a very large sweet spot and more good hits. The racket has maximally long strings at all points on the racket face and strings substantially identical in length at all points on the racket face resulting in a uniformity of response for off-center hits, an increase in the ball rebound speed, a decrease in angular deflection for off-center hits, and the ability to set the tension of the strings such that they vibrate with the same frequency. The racket has a greater moment of inertia than conventional rackets, resulting in reduced racket rotation and a reduction of injuries to players, such as "tennis elbow".

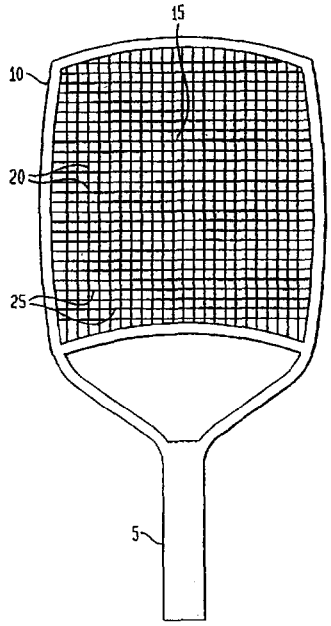

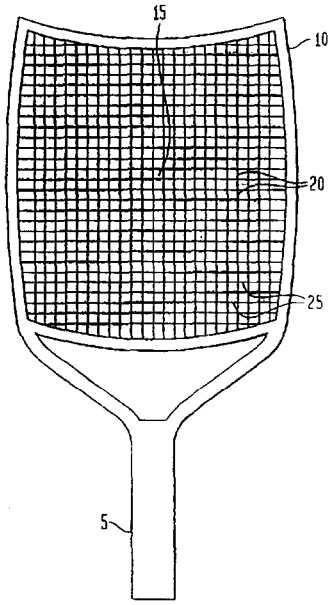

3 Claims, 16 Drawing Sheets